United States Patent [19]

Kruyer

[11] Patent Number: 4,511,461

[45] Date of Patent: Apr. 16, 1985

[54] PROCESS FOR RECOVERING MINERALS AND METALS BY OLEOPHILIC ADHESION

[76] Inventor: Jan Kruyer, 4643 82nd Ave., Edmonton, Alberta, Canada, T6B 2L9

[21] Appl. No.: 511,776

[22] Filed: Jul. 6, 1983

[51] Int. Cl.[3] ..... B07B 13/00

[52] U.S. Cl. ..... 209/47; 209/49; 209/166; 209/168; 209/171; 209/272; 209/307; 208/11 LE; 210/783

[58] Field of Search ..... 208/11 LE; 209/9, 10–13, 209/45–47, 49, 166, 168, 268, 171, 272, 307; 210/783

[56] References Cited

U.S. PATENT DOCUMENTS

| | | | |
|---|---|---|---|
| 1,159,713 | 11/1915 | Rowand | 209/9 |
| 1,263,503 | 4/1918 | Wood | 209/9 |
| 1,478,703 | 12/1923 | Dolbear | 209/168 |
| 2,189,698 | 2/1940 | Bierbrauer | 209/49 |
| 2,291,447 | 7/1942 | Bierbrauer | 209/49 |
| 4,224,138 | 9/1980 | Kruyer | 208/11 E |
| 4,236,995 | 12/1980 | Kruyer | 208/11 E |
| 4,248,697 | 2/1981 | Halvorsen | 209/49 |

*Primary Examiner*—Bernard Nozick

*Attorney, Agent, or Firm*—Thorpe, North & Western

[57] ABSTRACT

A mixture containing oleophilic surfaced mineral particles and oleophobic gangue particles in an aqueous phase is separated by means of an apertured oleophilic endless sieve supported in a separation zone by a revolving cylindrical cage having apertured sidewalls and supported in a recovery zone by a support roller, each section of sieve surface alternately revolves through the separation zone and recovery zone. The aqueous mixture is introduced as a slurry into the rotating cage. The endless sieve partly covers the outside surface of the cylindrical cage sidewall. An oleophilic adhesive is placed on the sieve as a coating or added to the aqueous slurry in the cage or both. The mixture tumbles inside of the cage and passes through the cage sidewall apertures to the sieve surface. The oleophilic mineral particles of the mixture adhere to the oleophilic adhesive and are captured by the sieve upon contact and conveyed out of the separation zone into the recovery zone.

In the recovery zone, mineral particles and adhesive mixture are heated and removed from the sieve by squeezing the mixture on the sieve between two rollers at least one of which is oleophilic. Alternately, the mineral particles and adhesive mixture on the sieve may because of its apertured surface, be blown off, shaken off or thrown off the sieve under the influence of an applied force.

39 Claims, 11 Drawing Figures

PROCESS FOR RECOVERING MINERALS AND METALS BY OLEOPHILIC ADHESION

BACKGROUND OF THE INVENTION

This invention relates to a process for the recovery of oleophilic surfaced mineral particles from gangue by attracting said mineral particles to the surface of an oleophilic sieve. More particularly, this invention relates to a process for the separation and recovery of oleophilic surfaced mineral particles from gangue utilizing an endless oleophilic conveyor sieve operating in conjunction with specified separation and recovery means.

Industrial nations are constantly increasing their metal consumption and the known supply of metal, and particularly copper, lead and zinc, is shrinking. In a few years, the metal industry may not be able to supply the world needs. Similarly, the supply of previous metals and minerals is shrinking. There are, however, still large quantities of minerals and metals in very low grade ore that have been heretofore untouched because of the difficulty in recovering the valuable minerals and metals from the other solid materials, referred to as gangue, which are of little value.

In the low grade ore, the desired minerals many times appear only as just a few specks mixed with other minerals and solids, and a great amount of material must be handled to recover the small amount of desired mineral or metal. Any process for recovery of the desired minerals from low grade ore should involve as few handling steps as possible.

In addition, there has been difficulty in developing processes that can detect or select the small amount of mineral from the large amount of solids of little value generally termed gangue. This operation known as ore dressing or concentration generally involves comminution or fragmentation of the ore to small size to permit easy separation of the different kinds of solids, followed by one or more sorting operations designed to distinguish and separate the valuable mineral particles from the rest. In the past, the sorting has generally been accomplished by techniques, such as, for example, those based on gravity, magnetism, chemical attraction or reaction.

The gravity separation processes depend upon the different rates of fall through water and are patterned after the simple panning technique where the particles are swirled with water in a shallow conical dish with the effect that the dense particles stratify in the bottom while the lighter mineral, being more buoyant, remain partly suspended and can be decanted with water from time to time. The modern successors to the panning technique use more complicated steps and equipment, but the process is still limited by difficulty of obtaining particles of the right size, interference with walls and bottom of the containing vessels, and the like.

The magnetic separation process can be used for separating only a few minerals. The most obvious case is that of the ferromagnetic magnetite and minerals that can be chemically altered to become magnetic. Such separators work efficiently only if the material is presented in rather a thin layer only a few particles deep. Consequently, the design of a high capacity plant for use with fine material at reasonable cost is scarcely practicable.

The contact method of concentrating ore by causing its adhesion to a solid wall, such as a greased table, a greased solid belt, or the interior solid surface of a drum, is taught in U.S. Pat. Nos. 1,448,928 and 3,399,765. However, this method works efficiently only if the ore mixture to be separated is presented to the wall in rather a thin layer which is at most a few particles deep. Such a method requires an inordinately large solid surface area to affect a high rate of ore separation. Consequently, the design of a high capacity plant at a reasonable cost for that process is impracticable.

Froth flotation is probably the more desirable of the sorting processes as it operates through the sensitive surface properties of the individual minerals. It is generally applicable to very fine concentrates and can distinguish, not only ore mineral from gangue, but one mineral from another. Briefly, conditions are arranged so that when a mixture is agitated and air bubbles are blown through it, certain minerals attach themselves to the bubbles and are floated out of a froth which is skimmed off and discharged of its mineral burden. In many cases, the surface properties of the ore and gangue minerals vary within too narrow a range to be useful for effective separation, and, as a result, certain organic compounds called collectors are added to bring about more selective adsorbtion. The main type of collectors are organic acids, their salts, organic bases and oils, such as kerosene, creosotes, diesel or fuel oils. To be effective, these processes generally require strict control over particle size, of pH and the addition of many additives, such as conditioners, wetting agents, frothing agents, which add greatly to the cost, particularly when treating large quantities of ore. In addition, the technique requires that the minerals be ground to very fine particles before an effective separation can be accomplished.

OBJECTS OF THE INVENTION

It is an object of the present invention to provide a new and improved oleophilic adhesion process for extracting metals and minerals from mixtures containing them.

It is a further object of the invention to provide a process for sorting or extracting valuable metals and minerals from gangue by an oleophilic adhesion technique, which can be effectively operated on large quantities of ore with few operational steps, is operative with particles of great variety of size, is dependent upon very few process variables and can be made effective for the separation of a great variety of different metals and mineral ores.

SUMMARY OF THE INVENTION

It has been discovered that these and other objects can be accomplished by the process of the invention which provides a new, improved and highly efficient technique for recovering valuable minerals from an aqueous slurry consisting of mixtures containing the said minerals and particles of little value termed gangue, and particularly low grade ore containing the minerals or metals. The process comprises (1) insuring that each mineral particle in the slurry mixture has an oleophilic surface sufficiently large that when coated with an oil phase adhesive such as a viscous hydrocarbon or with any other oleophilic materials, it will adhere to an oleophilic sieve, (2) passing the resulting slurry mixture through an oleophilic sieve in a separation zone so that the oil phase adhesive coated mineral particle surfaces adhere to said oleophilic sieve upon contact and the remaining aqueous portion of the mixture containing the gangue passes through the sieve apertures, (3) removing the mineral particles and oil phase adhesive from the oleophilic sieve as a mixture in a recovery zone and, optionally, (4) cleaning, refining and/or processing the recovered mineral.

More specifically, a slurry mixture containing the mineral particles and gangue in an aqueous phase medium is separated by means of an apertured oleophilic endless sieve supported in a separation zone by a revolving cylindrical cage having apertured sidewalls and supported in a recovery zone by a support roller, each section of sieve surface alternately revolves through the separation zone and recovery zone. The slurry mixture and an oil phase adhesive are introduced into the rotating cage in the separation zone. The endless sieve covers the full width of outside surface of the cylindrical cage sidewall for part of its circumference. The slurry mixture tumbles inside of the cage and coats the mineral particles with the oil phase adhesive. The tumbling also brings the slurry up to sieve speed, which then passes through the cage sidewall apertures to the sieve surface. The gangue and aqueous phase of the mixture pass through the sieve apertures into a bath from where it is removed. The oil phase adhesive and coated mineral particles are captured by the sieve upon contact and are conveyed out of the separation zone. Some residual aqueous phase is removed from the sieve after which it passes into the recovery zone where the oil phase adhesive and coated mineral particles are removed as a mixture from the sieve for further processing.

Instead of adding the oil phase adhesive to the slurry mixture, the sieve may be precoated with the viscous oleophilic oil phase adhesive coating, such as bitumen, grease, coal, tar, pine oil, petroleum jelly, kerogen oil, heavy oil, animal fat, vegetable oil, and the like, prior to entering the separation zone to capture the mineral particles. If desired, the oleophilic oil phase adhesive may be added to both the slurry and the oleophilic sieve to capture the mineral particles. What is important is that one or the other, or both, be used as a "glue" to capture the mineral particles in the separation zone and hold them on the sieve for subsequent removal in the recovery zone while allowing the gangue and aqueous phase to pass through the sieve apertures in the separation zone.

In the recovery zone, the mineral particles and oil phase adhesive mixture is removed from the sieve by squeezing the sieve between two rollers such that the mixture materials which will not pass the nip between the rollers fall off the sieve. At least one of these rollers is oleophilic and pulls the oil phase-mineral mixture out of the sieve apertures which mixture coats the roller surfaces and revolves back to the nip between the rollers and is squeezed off. This may be done with the sieve as it enters the recovery zone without heating it or the sieve and the oil phase-mineral mixture on the sieve may be heated with a hot roller to make squeezing off of the mixture easier. Alternately, the mixture on the sieve may be heated in the recovery zone and, because of its apertured surface, blown off, shaken off or thrown off the sieve under the influence of an applied force.

For effective operation to assure long wearing of the apertured sieve, air cylinders operated with controlled air pressure may be used to maintain sieve tension and to control tracking of the sieve on the cylindrical surfaces.

It has been surprisingly found that by the use of this unique process, one can effect an efficient separation even of small quantities of mineral or metal from large quantities or ore, and can effect such a separation with a small number of operational steps. In addition, the separation can be effected without the use of large quantities of expensive additives and without strict control of reaction conditions, such as pH, temperature, particle size, and the like. Furthermore, it is in the nature of the sieve of the invention that water and gangue which are not intended to be captured by the sieve can flow directly through the sieve wall and get out of the way of the oil phase and minerals that will thereby more readily adhere to the oleophilic sieve surfaces upon contact to achieve the separation. This is in contrast with prior art processes that use a solid wall for the separation and do not permit such water and gangue removal to bring the minerals in more immediate contact with the oleophilic surface for capture.

DRAWINGS

DETAILED DESCRIPTION OF THE INVENTION

Figure 1:
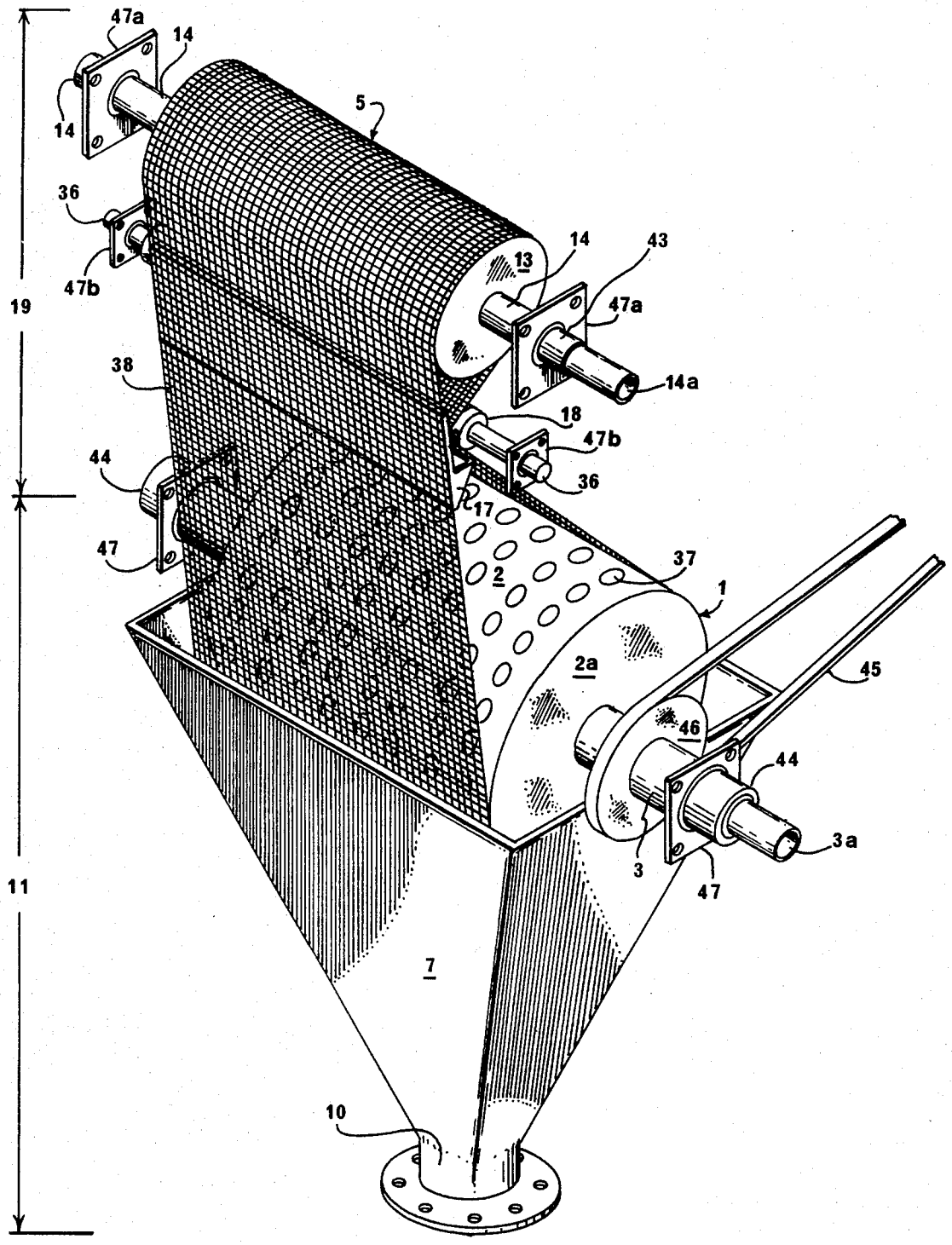
FIG. 1 is a perspective view of one system of the invention used to practice one method of the invention showing a tumbling cage in the form of a drum, a separation sieve, a recovery means and a bath.

The first step of the process of the invention involves insuring that the mineral particles in the mixture have an oleophilic surface of sufficient area to effect adhesion of the particles to the oleophilic sieve upon contact.

As used herein, "oleophilic" refers to those surfaces or materials which are attracted to and wettable with oil, as distinguished from "oleophobic" wherein the surfaces are not so attracted or wetted with oil. Similarly, "hydrophilic" refers to those surfaces or materials which are attracted to and wettable with water. Generally, surfaces which are hydrophilic also are oleophobic.

It has been found that many precious minerals, metals and gem stones tend to be naturally oleophilic and have oleophilic surfaces unless they are coated with slime or with films of hydrophilic matter. Metals that are not easily oxidized, such as tin, also tend to have oleophilic surfaces. Cadmium and some metal oxides also are oleophilic. Broadly speaking, sulfide minerals are or can be made to be oleophilic, but silicates are mostly hydrophilic. Graphite, diamonds, copper and silver in their native state are or can be made to be oleophilic. Gold particles, when in flakes or in platelet form, have oleophilic surfaces. In some cases, gold particles may be coated with metallic oxides or clay or a hydrophobic film, and such coatings should be removed by abrasion to expose the oleophilic metal surfaces. Generally, tumbling of the minerals with gangue in the rotating tumbler or cage of the instant invention provides considerable abrasion and can be sufficient to strip hydrophilic (oleophobic) films from the mineral surface. Silver is also found in the form of small flakes wherein the surfaces are or can be made oleophilic. If coated with an oleophobic film, the film must first be removed by tumbling in a cage.

Those ores or minerals which are not naturally oleophilic can be made oleophilic by contacting them with what is termed an activator. These materials normally act in solution by adsorbing on the surface/solution interface, thereby providing sites for adsorbtion of collector species or liquid hydrocarbon, as will be described. For example, addition of oxygen to a gold bearing water suspension will increase the oleophilic attraction of the gold particles.

Minerals can also be made oleophilic by the addition of agents known as collectors. These materials provide the surface of the mineral that is to be recovered with an oily film that makes the mineral oleophilic. Preferred collectors are those which adhere to the mineral surface to the exclusion of the gangue and which have a hydrocarbon chain or a hydrocarbon ring in one part of the molecule such as at one end of the molecule and may, at the other end, have a polar element that is likely to combine with the mineral surface.

The oleophilic collector material added can be long chain aliphatic ionizing compounds which dissociate into ions in aqueous mixtures and act by attaching at the polar moiety of the aliphatic compound to the surface of the desired mineral particles and thereby impart the desired oleophilic properties. The olephilic collector may also be long chain chelate type materials which enter into a weak chemical bond with the minral particles. The added oleophilic collector can also be non-ionizing compounds or compositions which are practically insoluble and effect the desired results by forming a thin film on the surface of the mineral particles and, thus, impart the desired oleophilic character to the resulting combination.

Preferred ionizing collectors to be used are $C_{12}$ to $C_{26}$ aliphatic carboxylic acids and alkali and alkaline earth metal salts and xanthate esters thereof, and $C_{12}$ to $C_{26}$ aliphatic sulfates, sulfonates, dithiophosphates, amines and halides. The aliphatic radical may be saturated or unsaturated and may be also be substituted by aryl groups. Preferred ionizing collectors are fatty acids and salts thereof, such as oleic acid, sodium oleate, linoleic acid and sodium linoleate.

The exact ionic collector to be used in the process will depend chiefly upon the electrostatic attraction between the polar head of the collector and the charged electrical layer on the mineral surface, and a few routine tests will review the most efficient combination of mineral and collector to be utilized.

The non-ionic collectors are the same as the oleophilic oil phase adhesives and generally function by coating the surface of the mineral particles. These collectors may be of any suitable type as long as the necessary attraction to the mineral particle is provided. Examples of suitable non-ionic materials include, among others, bitumen, heavy oil, petroleum jelly, pine oil, crude oil, coal tar, kerogen oil, animal fats, vegetable oils, grease, and the like and mixtures thereof.

Gangue particles, on their surfaces, can be made hydrophilic or more hydrophilic by the addition of hydrophilic surface active transfer agents, such as sodium, potassium and ammonium polyphosphates. Generally water soluble salts of pyrophosphoric acid are transfer agents and may be mixed with the feed or the tumbler contents. For many gangue materials such addition will effect an improvement in the water wetability of the gangue surfaces and will improve the separation in the process of the invention.

The first step in the process then is to be sure that the mineral particles have an oleophilic surface and the gangue particles have mostly hydrophilic (oleophobic) surfaces. This is accomplished when the mineral particles by nature have oleophilic surfaces and the gangue by nature has oleophobic surfaces. Or the conditions can be adjusted if desired by the addition of activators, collectors, transfer agents, or by the addition of a combination of these to achieve oleophilic mineral surfaces and oleophobic or hydrophilic gange. The exact procedure to be used will depend upon the mineral and gangue to be separated.

The exposed portion of the mineral particle should also be large enough that the oleophilic mineral surface will adhere to the oleophilic surfaces of the sieve with the assistance of an oleophilic oil phase adhesive during the separation step. If the area is not large enough, the mineral particle will not adhere sufficiently to the oleophilic sieve surfaces to be carried or conveyed away from the separation zone, but will pass through the apertures of the oleophilic sieve and become part of the gangue after separation. The exposed mineral particle surface can be increased by grinding or crushing or the mean mixture particle surface can be increased by sieving the ore prior to separation by the process of the invention. The ore for separation should preferably have a particle size of 5 mesh (2.5 mm) or less, and more preferably from 5 mesh (2500 micron) to 250 mesh (50 micron). The crushing can be accomplished by any conventional technique, such as jaw crushers, gyratory crushers or rolls, and if smaller particles are desired, they may be obtained by use of ball mills or similar equipment. After a suitable particle size is obtained, the ore is slurried in water and mixed with any desired reagents or additives and tumbled in a rotating cage. The tumbled mixture containing the mineral particles having oleophilic surfaces is then treated to separate the mineral particles from the gangue. This may be accomplished in a variety of ways within the scope of the invention. One technique comprises passing the slurry mixture of mineral particles having the oleophilic surfaces and the gangue, through apertures in the cage sidewalls onto an endless apertured oleophilic sieve conveyor wrapped around the cage, which sieve is coated with an oleophilic oil phase adhesive material which captures the oleophilic mineral particles upon contact while permitting the hydrophilic (oleophobic) gangue particles to pass through the apertures of the oleophilic sieve in the separation zone. The mineral particles are removed from the sieve so that these may be subsequently cleaned and/or processed to become the minerals product of the process and the oleophilic sieve is again coated with the adhesive to capture more mineral particles as this sieve revolves back into the separation zone. Oleophilic oil phase adhesive as used in this specification refers to any oleophilic viscous substance which is not a solid and which can be made to flow under pressure and which is sticky, such as bitumen, heavy oil, pine oil, crude oil, grease, kerogen oil, coal tar, petroleum jelly, animal fat, vegetable oil, and the like and which are oleophilic. Heavy oil is inclusive of asphalt and other refinery bottoms.

A preferred embodiment comprises mixing the ore, consisting of mineral particles having the oleophilic surfaces and gangue, with an aqueous phase and an oil phase adhesive so that the mineral particle surfaces become coated with a thick coating of the adhesive and the gangue becomes coated with water. This is preferably accomplished by tumbling the mineral particles, gangue, water and oil phase adhesive in a cage for a sufficient period to insure that the oleophilic exposed mineral particles surfaces become coated with a coating of adhesive which is thick enough to cause adhesion of the mineral particles to an oleophilic sieve during separation and to insure that the gangue particles are wetted with water. The tumbled mixture is then passed through the cylindrical cage wall and onto the oleophilic sieve surrounding the cage in the separation zone where the mineral particle surfaces, coated with adhesive, contact and adhere to the oleophilic surface of the sieve and the hydrophilic gangue particles pass through the sieve apertures. The mineral particles and adhesive adhering to the oleophilic surface of the sieve are carried out of the separation zone by the revolving sieve and enter a minerals recovery zone where the mineral particles and oil phase adhesive are removed from the sieve as a mixture. The process is continuous in that each section of the sieve revolves continuously and sequently through the separation zone, through the recovery zone, and back to the separation zone, etc. There is no need to apply a coating of oil phase adhesive to the oleophilic sieve in this case since the mineral surfaces become coated during tumbling in the drum with a thick layer of the adhesive which causes subsequent adhesion of the mineral particles to the oleophilic sieve surfaces upon contact.

Another embodiment comprises continuously adding an emulsion of oil phase adhesive and water to the mixture of mineral particles and gangue before or after it enters the cage and adding an emulsion breaker to the mixture. The aqueous phase used in this case is the continuous phase and contains oil phase adhesive as the dispersed phase. When the emulsion breaker is added to the mixture, oil phase adhesive particles come out of emulsion and are free to find the oleophilic surfaces of the mineral particles and adhere thereto. Such mineral particles then become coated with a thick coating of the adhesive material. The resulting mixture is then passes from the cage to the oleophilic sieve wherein the mineral particles coated with oil phase adhesive adhere to the oleophilic surfaces of the sieve upon contact, and the hydrophilic gangue passes through the apertures of said sieve. The captured mineral particles and oil phase are then continuously removed out of the separation zone and into the minerals recovery zone as described in the above embodiments of the invention.

Suitable emulsion breakers for use in the process of the invention are inorganic alkaline earth hydroxides or salts, such as calcium sulphate or calcium hydroxide. Other suitable emulsion breakers are non-ionic surface active compounds, as for example, a chemical demulsifier comprising polyethoxyalkene compound, sold under the tradename of NALCO D-1645 produced by the Nalco Chemical Company. There are a great number of demulsifiers on the market and a few simple tests are sufficient to determine those most effective for a particular mixture to be separated. The most important criterion for evaluating a demulsifier for use in the process of the instant invention is that it should render the oil phase adhesive coming out of emulsion strongly oleophilic so that it will readily attach to mineral particle surfaces of the mixture.

Minerals that may be present in tar sands include titanium ore such as ilmenite and rutile, zirconium ore such as zircon, gold, silver, platinum, uranium, galena, and other minerals. Each of these may be recovered along with bitumen in the process of the invention.

PREFERRED EMBODIMENT

A particularly preferred embodiment of the invention comprises recovering the minerals from mixtures containing it and gangue wherein the ore is slurried with water and an oil phase adhesive is added to the mixture.

In this embodiment, the ore particles, preferably between 50 and 2500 microns in size, are mixed with water and oil phase adhesive in a rotating tumbler cage, to effect a thorough mixing of the components and provide an opportunity for the mineral particles to come in contact with the oil phase and to abrade oleophobic coatings from the mineral surfaces to permit adhesion of the adhesive to the mineral surfaces. Steam may be used as well as other materials, such as suspension agents, stabilizers, activators, collectors, and the like may be added, as desired, to assist in the formation of the mixture in the rotating tumbler cage. While water is the desired continuous mixture medium, it is also possible to utilize solvents or water-solvent mixtures or emulsions to form the desired mixture.

The amount of water used in the mixture may vary over a wide range. The amount should be sufficient to give the mixture sufficient fluidity so there will be proper mixing in the formation of the mixture and sufficient fluidity for passage through the oleophilic sieve. In general, the amount of water employed will vary from 0.1 to 5.0 tons of water per ton of ore, depending upon the particle size of the ore in the mixture.

Mixing in the tumbler may be improved by keeping a number of steel, metal or rubber free bodies such as balls or rods in the tumbler to assist in stirring the mixture as it tumbles. These free bodies preferably should have oleophilic surfaces to assistirring the mixture as it tumbles. These balls or rods preferably should have oleophilic surfaces to assist in smearing oil phase adhesive on the mineral particle surfaces. The size of these balls or rods preferably are much larger than the apertures of the oleophilic sieve and preferably larger than the apertures in the apertured cylindrical wall of the tumbler cage so that these remain inside the tumbler at all times, but these may wear down in size with time due to abrasion in the mixture and then sporadically leave the tumbler with the gangue or with the minerals. Rods used may be solid bars or pipes slightly shorter than the cage, or neoprene balls or artificial rubber balls or balls of any other material may be used instead in the tumbler cage for the purpose of improving the mixing in the tumbler and the transfer of oil phase adhesive to the surfaces of the mineral. In some cases, it may be desirable to charge the tumbler with a large number of such balls to speed up abrasion, mixing and transfer of oil phase adhesive. Oleophilic cylinders, of shorter length than the above rods, or other shapes may be used in the tumbler for the same purpose as balls to improve the objectives of the process of the invention.

The desired temperature to be used in the tumbler cage will also vary over a wide range and is dictated, to a large degree, by the viscosity of the oil phase adhesive used and the amount of water in the mixture. Temperatures will not be below the freezing temperature of water or above the boiling temperature of water. A mixture with 50% water content by weight, using Athabasca bitumen for the oil phase adhesive, maintained at 25° to 50° C. is an acceptable compromise for many of the ore feedstocks. What is important is that sufficient water be present to allow all mixture components to be mixed in the cage at the temperature selected and to allow the mineral particle surfaces to become coated with adhesive of sufficient thickness to cause adhesion to the oleophilic surfaces of the oleophilic endless sieve upon contact.

For some oil phase adhesives the adhesion properties for certain minerals may vary with temperature. This permits selective recovery of one mineral from another mineral and from gangue by selecting the optimum adhesive and the optimum temperature for recovery of the selected mineral.

The oil phase adhesive to be added to the slurry can be one of those described above, as long as it has the desired oleophilic properties to attach to the desired mineral particle surfaces and in combination therewith to adhere to the oleophilic surfaces of the endless sieve upon contact.

Oil phase adhesives to be used in the preferred embodiments inclue bitumen, coal tar, heavy oils, petroleum jelly and greases. Particularly preferred adhesives include hydrocarbon compositions having molecular weights up to about 20,000, and more preferably, those of the group consisting of bitumens, heavy oils and hydrocarbon polymers derived from olefins or diolefins. The oil phase adhesive to be used may be a single component or a mixture of two or more materials.

The amount of oil phase adhesive to be present in the mixture in the tumbler may vary over a wide range depending upon the concentration of the desired mineral to be recovered, nature of the bond to be employed, temperature and fluidity of the mixture and size of the particles in the mixture. Preferably, the amount of adhesive will vary from about 1% to 150% of the weight of the ore being treated.

The desired mixture is prepared by introducing the water and oil phase adhesive and mineral ore into a rotating cage so as to effect a thorough mixing of the components and provide an opportunity for the oleophilic surfaces of the mineral particles to come in contact with, and be coated by, the oil phase, with or without activation of the mineral surfaces by activators or collectors, as desired.

The mixture is continuously transferred from the cage interior to the oleophilic endless sieve wrapped around the cage where the gangue passes through the sieve apertures along with water, the coated mineral and oil phase adhesive adheres to the sieve surfaces upon contact and are conveyed by the sieve, and the mineral particles and oil phase adhesive and thereafter recovered from the sieve surfaces as a mixture.

The process of the invention can be used to recover a great variety of different minerals from mixtures containing the same. The minerals may occur in the ore as free metals or in combination with other chemical radicals, such as sulfides, and the like. Naturally occurring gem stones may reside in the gangue as individual mineral particles or may be attached to gangue particles, which are then recovered along with these precious stones.

Preferred minerals to be recovered by the process of the invention are those which are substantially precious metals, precious gem stones and, particularly, those metals or ores of metals which have atomic weights between 40 and 250. Compounds containing these metals and their oxides, and especially their sulfides, halides and manganates, are particularly effective in the process of the invention.

A few metals, such as gold, occur naturally as free metals, but most of the metals occur in ores where they are bound in crystalline structure with other chemical groups or radicals, such as sulfides, and the like radicals.

As indicated above, while some minerals may not be oleophilic, per se, they can be made oleophilic by use of activators or collectors. Examples of ore that can be treated by the process of the invention include, among others, ores containing titanium such as ilmenite and rutile; those containing manganese which include psilomelane, pyrolusite, manganite, rhodochrosite; those containing chromium, which include chromites, serpentinites; those containing nickel, which include pentlandite, pyrrhotite, garnierite; those containing cobalt, which include linnaeite, cobaltite, smaltite; those containing tungsten, which include scheelite, wolframite; those containing molybdenum, which include molybdenite; those containing vanadium, which include vanadate, vanadinite, carnotite; those containing lead and zinc, which include galena, sphalerite, chalcopyrite; those containing mercury, which include cinnabar; those containing antimony, which include stibnite; those containing bismuth, which include bismuthinite; those containing aluminum, which include bauxite; those containing beryllium and lithium, which include beryl, spodumene; those containing magnesium, which include carnallite, magnesite, dolomite; those containing gold, which include gold tellurides; those containing silver, which include argentite, proustite, pyrargyrite; those containing platimum group metals, which include chromespinellides, sperrylite; those containing uranium and thorium, which include pitchblende, uraninite, carnotite; those containing tantalum and niobium, which include tantalite, columbite, microlite, pyrochlore; those containing zirconium and rare earths, which include zircon, monazite, xenotime; those containing cesium, germanium, thallium, scandium, cadmium, selenium, tellurium, ribidium, gallium, hafnium and rhenium.

The process of the invention can also be used to advantage in the purification of sludge ponds at industrial sites from minerals or pseudominerals where the sludge may contain undesirable oleophilic hazardous or radioactive products, such as toxins, PCB's, or decay products from atomic reactions or explosions which can be made oleophilic or which are oleophilic. The process may be used to remove radioactive wastes from disposal sites by the selection of a suitable activator which turns the waste substance into a particulate oleophilic material.

The process may also be used to remove pseudominerals such as proteins from mixtures containing proteins and the like substances by the selection of a suitable activator and, where required, a suitable hydrophilic transfer agent, to make the protein more oleophilic and the other substances more hydrophilic.

The process of the invention may also be used in the preparation or concentration of other pseudominerals such as enzymes, vaccines, bacteria or other beneficial medicines or biological preparations by chosing an appropriate activator, a suitable oil phase adhesive or a hydrophilic transfer agent, as required.

SEPARATION ZONE

The preferred embodiments of systems and methods to be used in practicing the invention are shown in the FIGS. 1, 2, 3, and 4. The term "cage" is used to describe any structure having an apertured cylindrical sidewall enclosed by endwalls and rotatable about a generally horizontal axis. Any cage will be operable in the present invention if it meets the following requirements. The cage must be capable of tumbling water and particulate solids mixture that may contain dispersed oil phase in preparation for distribution on the surface of an endless apertured oleophilic sieve. The cage must function as a conveyor roller to support the endless sieve in the manner of a conveyor belt in tracking alignment. The cage sidewall must be so constructed that free bodies, if any, tumbling inside the cage, to assist in preparation of the mixture, cannot protrude through the sidewall apertures sufficiently to deform the surface of the sieve and adversely affect sieve operation. Finally, and perhaps most importantly, the apertures in the cage and in the sieve encircling the cage must cooperate in tandem as the sieve contacts and rotates with the cage such that mixture passing through the cage apertures will be deposited onto the sieve surface area for optimum separation by the sieve.

The various embodiments of the invention will now be described in detail.

While the various figures illustrate different embodiments of the invention, there are obvious similarities shown in each figure. Thus, while certain elements may be depicted somewhat differently in each of the figures, they will bear the same numeral if they are used to perform the same function in the same manner. For example, the cage, whether it is a drum or a grizzly, will be referred to by the same numeral as will the conveyor roller, whether it is heated or cold or has an oleophilic surface or not.

FIG. 1 is a perspective view of a typical separation and recovery apparatus. This figure shows a drum 1 with an apertured cylindrical wall 2 and solid endwalls 2*a* supported by shafts 3 in bearings 47 and driven with a belt 45 and sheave 46 by a motor (not shown) to cause the drum 1 to rotate and cause the endless sieve 5 to revolve and convey adhered mineral and oil phase adhesive out of a separation zone 11 into a recovery zone 19. The various components forming the aqueous ore slurry mixture, in premixed form or separately, flow into the drum through an inlet 3*a* in shaft 3 through a rotary seal 44 mounted to the hollow shaft 3 of the drum 1. A bath tank 7 with bottom outlet 10 is mounted around the lower portion of the drum to contain aqueous phase for removal. The level of aqueous phase (not shown) may be such as to partly immerse the drum 1 or may be maintained below the drum surface if so required. In this figure, motive drive is provided through the belt 45 and sheave 46 to the shaft 3 of the drum. Alternately, motive power can be provided to the other cylindrical surfaces in contact with the endless sieve 5, such as the conveyor roller 13 supported by shaft 14 and mounted in bearings 47*a* or deflection roller 18 supported by shaft 36 and mounted in bearings 47*b*, since the endless sieve 5 can transfer power between cylindrical surfaces in contact with the sieve. FIG. 1 shows that apertures 37 in the cylindrical drum wall 2 can be and usually are larger than the apertures 38 in the wall of the oleophilic endless sieve 5.

Separation using the apparatus of FIG. 1 is achieved by introducing a slurry, consisting of a mineral-gangue ore mixture combined with oil phase adhesive and water phase into the interior of the revolving drum 1 such that the mixture distributes evenly over the drum interior length and then passes through the apertures 37 in the drum wall 2 to the surface of the sieve 5 where the separation takes place in a separation zone 11 where the sieve is in contact with the drum surface. In this separation zone, water phase and particulate solids (gangue) in the water phase pass through the sieve apertures 38 and are discarded while oil phase coated mineral particles and excess adhesive attach to the sieve upon contact because of adhesion to its oleophilic surfaces. The sieve revolves and the adhering mineral particles and oil phase adhesive mixture is continuously conveyed out of the separation zone 11 and into the recovery zone 19 where this mixture is recovered from said sieve as a product. Removal of the mineral and oil phase adhesive mixture from the sieve surface generally is enhanced by heat from the heated conveyor roller 13, followed by throwing the mineral and oil phase mixture off sieve 5 into hopper 17 by means of centrifugal force created by deflection roller 18; however, other methods of mineral and oil phase mixture removal from the sieve are also suitable for the process of this invention. The lower portion of drum surface in the separation zone and the sieve surface in contact with this drum may be immersed in a bath, if so desired, to improve the efficiency of separation. The specifics of separation and recovery will be discussed in greater detail with reference to the remaining figures.

Figure 2:
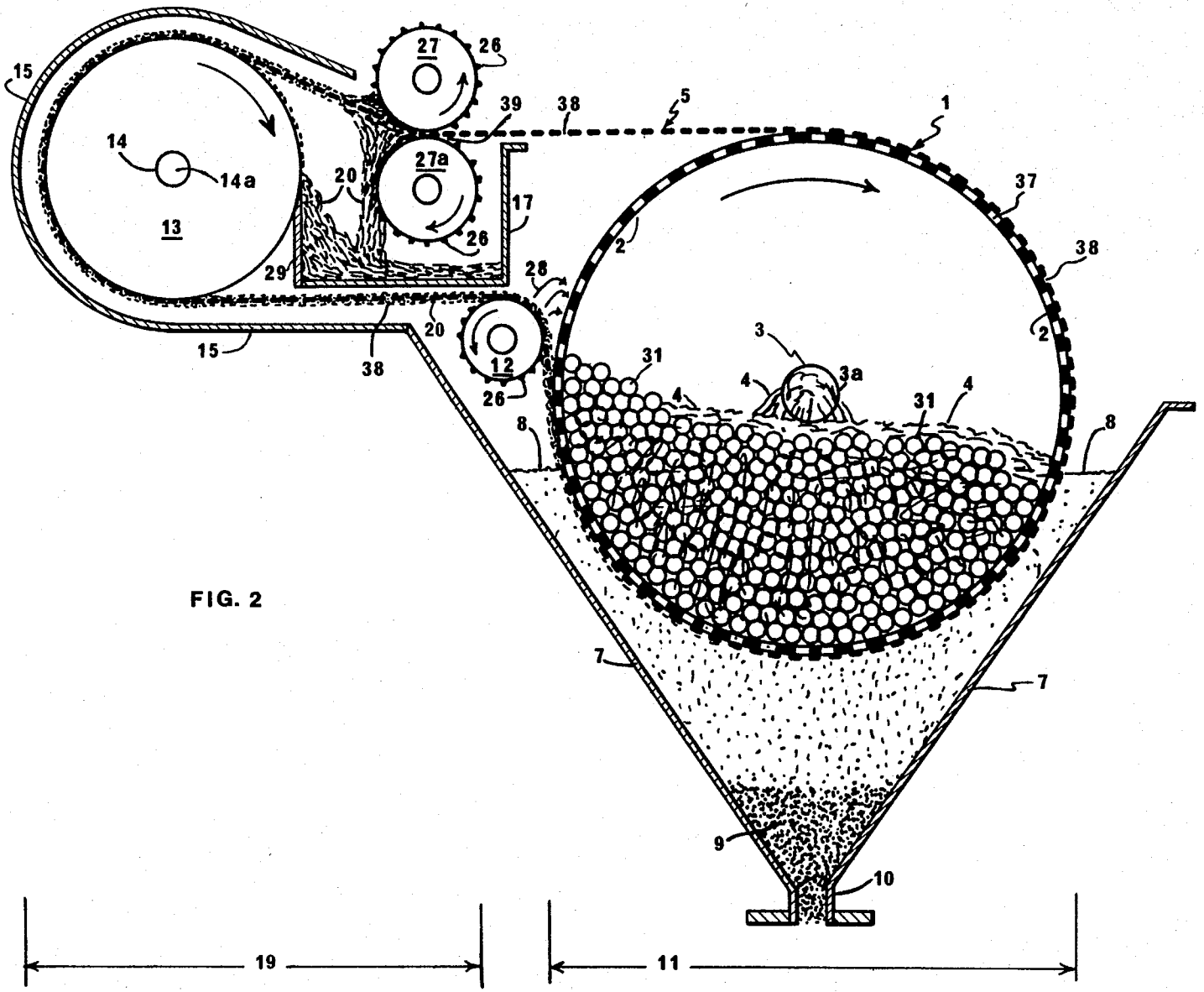
FIG. 2 is a cross sectional view of a second embodiment of a process and system for minerals and oil phase mixture separation showing a separation zone utilizing a rotating apertured drum containing free bodies, a dewatering roller, and a recovery zone utilizing a heated conveyor roller and separate squeeze rollers.

With reference to FIG. 2, a slurry mixture of minerals, gangue, oil phase adhesive and aqueous phase 4 enters through a central inlet 3*a* in shaft 3 of drum 1 that is provided with an apertured cylindrical wall 2 that supports an apertured oleophilic conveyor sieve 5. The direction of drum rotation and sieve movement is indicated by the directional arrows. Oleophilic spheres 31 are shown to reside in drum 1 and tumble with the mixture 4 in the drum to slow down the flow of mixture 4 to the sieve 5 and also to expose and coat the mineral particles with the oil phase adhesive before it reaches the surface of the sieve 5 in the separation zone 11. Mixture 4 with the mineral particles coated by oil phase adhesive pass through the drum apertures 37 to the sieve surface where aqueous phase and gange pass through the sieve apertures 38 and the coated mineral particles and oil phase 20 adheres to the sieve surfaces upon contact. The rotation of the sieve 5 carries the mineral particles and oil phase adhering to the sieve surfaces out of the separation zone 11 into the recovery zone 19. Aqueous phase and gangue that has passed through the sieve apertures 38 flow into the bath 7 which partly immerses the drum 1 as indicated by water level 8. Gangue particles 9 in the aqueous phase settle in the bottom of bath 7. Aqueous phase and gangue 9 are removed from the bottom 10 of the bath 7.

An oleophilic surfaced deflection roller 12 is used to train the sieve and keep the sieve in contact with the drum wall 2 well above the bath water level 8 and to displace water from the sieve, as indicated by arrows 28. Mounds of coated mineral particles and oil phase adhesive mixture 26 are continuously pulled out of the sieve apertures by the oleophilic surface of roller 12 and revolve with the roller surface back to the sieve 5 to displace aqueous phase, carried by the sieve 5 from the separation zone 11, out of the sieve apertures 38. Centrifugal force and gravitational force also assists in throwing aqueous phase, shown by arrows 28, back onto the drum wall 2 and back into the separation zone 11.

Operation of the recovery zone 19 portion of FIG. 2 is described later in this disclosure.

Figure 3:
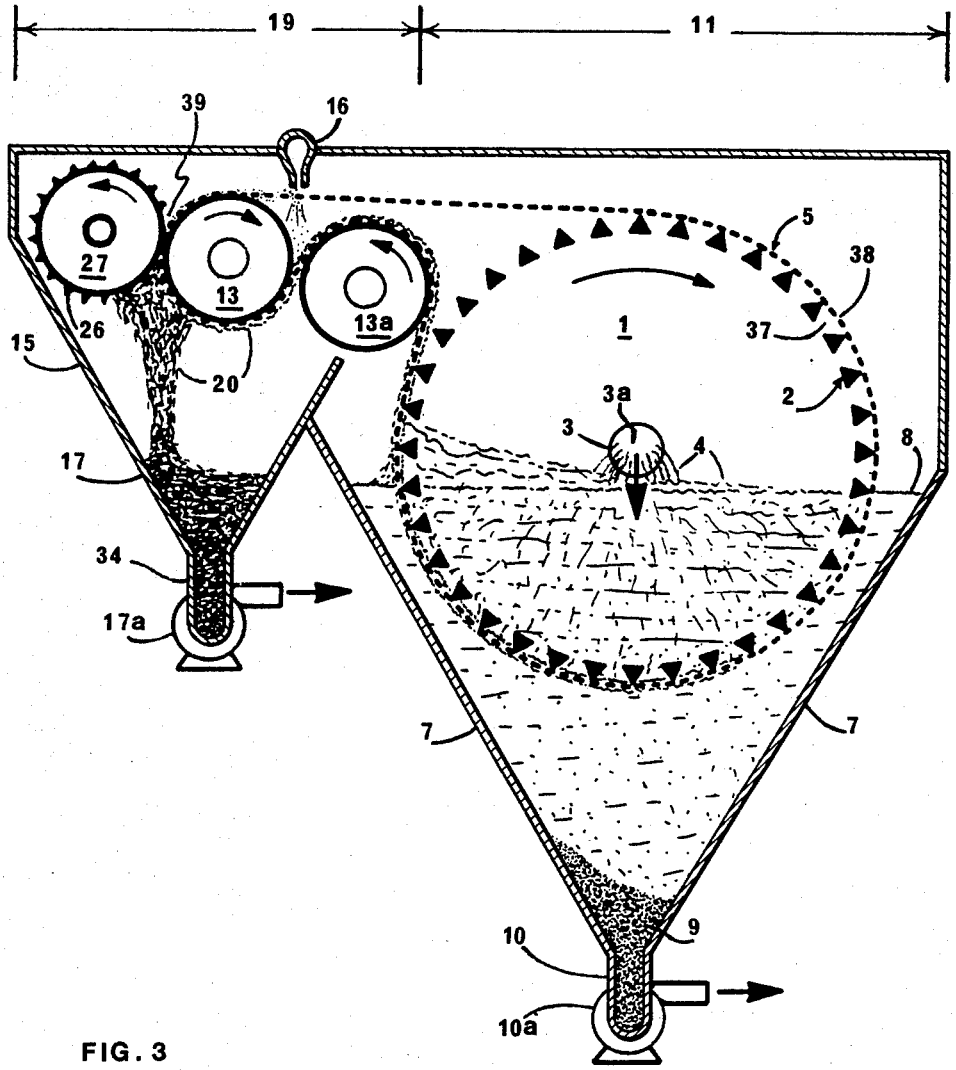
FIG. 3 is a cross sectional view of a third embodiment of a process and system for separation showing a separation zone utilizing a rotating cage in the form of a grizzly and a recovery zone utilizing two heated rollers and a squeeze roller forming a nip with one of the heated rollers for minerals and oil phase removal.

FIG. 3 is a representation of an embodiment utilizing a rotating grizzly instead of a drum. In this figure, grizzly 1 is provided with an apertured sidewall 2 formed by interconnecting grizzly bars with solid endwalls and internal braces or flanges and rotated about an axial shaft 3. A slurry mixture of minerals, gangue, oil phase and aqueous phase 4 enters the interior of grizzly 1 through an inlet 3*a* in shaft 3. The grizzly is partially immersed in a water bath 7 having a water level 8. The mixture is tumbled in grizzly 1 where oil phase adhesive coats the minerals particles to thereby increase their chance of subsequent capture by sieve 5.

The oleophilic sieve 5 having apertures 38 is in the form of an endless sieve conveyor supported by the cylindrical wall 2 of the grizzly in separation zone 11 and by two heated conveyor rollers 13 and 13*a* in recovery zone 19. Rollers 13 and 13*a* also provide sieve tension and tracking as will be subsequently explained.

The shape of the grizzly bars forming cylindrical wall 2 permits maximum use of the oleophilic sieve surface in the separation zone 11 while supporting the sieve. The grizzly 1, by its tumbling action, serves to deposit the slurry on the sieve uniformly across the full width thereof.

The relative velocity between the mixture contacting the sieve through the apertures 37 in the grizzly wall 2 and the sieve 5 is minimized because the mixture is brought up to the surface speed of the sieve by the grizzly before it comes in contact with the sieve. Abrasion of the sieve 5 in separation zone 11 is, thereby, minimized even at high sieve surface speeds.

The aqueous gangue containing phase of the mixture 4 passing through grizzly wall apertures 37 onto sieve 5 falls through sieve apertures 38 and the adhesive coated mineral particles and excess oil phase adhesive of said mixture adhere to the sieve surface and are removed to a recovery zone for removal from the sieve, as will be explained in the following section.

As previously noted, the sieve and grizzly are partly immersed in a water bath 7 to slow down the flow of mixture 4 to the sieve 5 and to encourage coating of the mineral particles with oil phase adhesive and adhesion of the oil phase adhesive mineral particle mixture to the sieve. Thus, no bearings or delicate mechanical parts come in contact with the mixture or water from the bath.

Particulate gangue solids 9 passing through sieve apertures 38 fall to the bottom of bath 7 and are pumped through outlet 10 by pump 10*a*, along with excess water to a dewatering pit or to a settling pond. If desired, the water from the dewatering pit or from the tailings pond may be recycled to prepare additional mineral, gangue, aqueous phase and oil phase adhesive mixture for separation.

Figure 4:
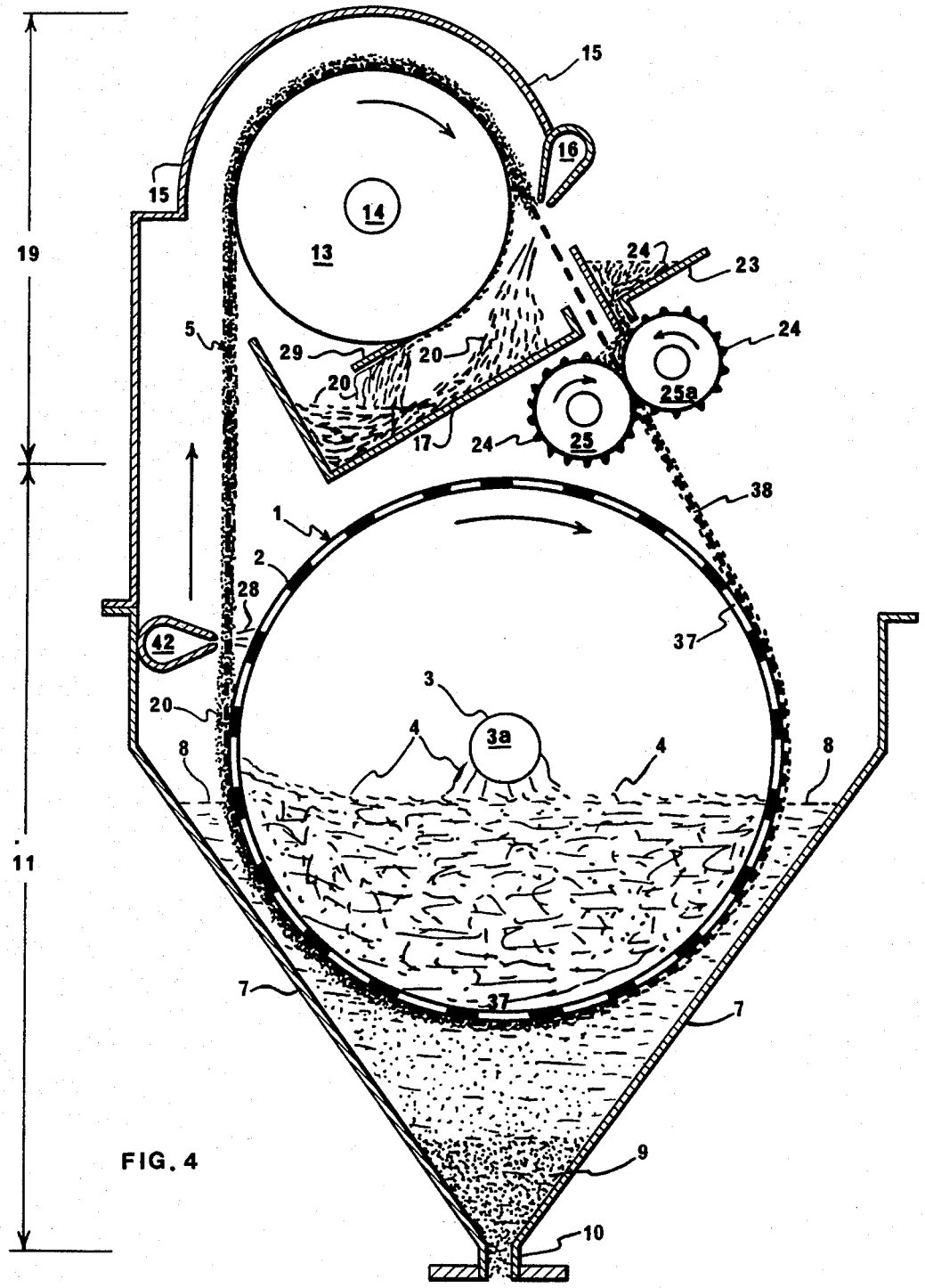
FIG. 4 is a cross sectional view of a still different embodiment of a system and process for separation showing a separation zone utilizing a rotating drum and a recovery zone wherein jetted air and a large heated roller and a scraper on the roller surface are used to remove minerals and oil phase from the sieve.

A still different separation embodiment is illustrated in FIG. 4. In this embodiment, a slurry mixture 4 of mineral, gangue and aqueous phase tumbling in a drum 1 without oleophilic free bodies is shown. For many mixtures separated by the process of the present invention, free bodies for agglomeration are not required in the drum. In this embodiment, mixture is introduced into the drum 1, through central inlet 3*a* in shaft 3, or through inlet means along a circumferential sector of the drum cylindrical wall not covered by the sieve, and mixture 4 tumbles in the drum and is brought up to sieve movement speed. It then passes through the drum apertures 37 in the cylindrical wall 2 of the drum to the oleophilic endless sieve 5 in the separation zone 11. The sieve is precoated with an oleophilic adhesive. Aqueous phase and gangue pass through the sieve apertures 38 and the mineral material of the mixture 20 adhere to the precoated sieve surfaces upon contact. It is then conveyed out of the separation zone 11 in the direction of sieve movement, as indicated by the directional arrows, into a recovery zone 19 where the minerals and some of the oil phase adhesive are removed from the sieve 5 as a mixture 20. Before the oil phase covered sieve having mineral particles adhering thereto enters the recovery zone, an air knife 42 is used to direct a jet of air against the surface of sieve 5 to remove aqueous phase droplets 28 out of the sieve apertures 38. Particulate gangue solids 9 of the aqueous phase, when large and heavy, settle to the bottom of the bath 7 to be removed through an opening 10 in the bath along with other aqueous phase to maintain a liquid level 8 in the bath.

Figure 5:
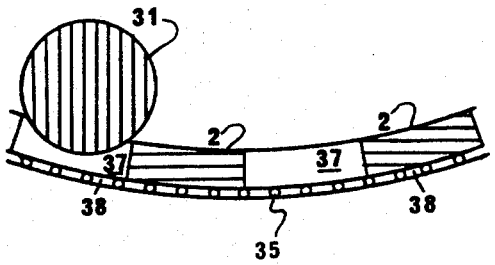
FIG. 5 is a detailed drawing of a drum wall, a free body inside the drum and a section of an endless sieve in contact with the outside surface of the drum wall.

FIG. 5 is an enlarged view of a section of the drum wall 2 in contact with the oleophilic sieve 5. While not necessary for the process, in this view, it is again shown that the drum apertures 37 can be and generally are much larger than the sieve apertures 38 and larger than the strands 35 which make up the sieve surfaces. The size of the drum apertures 37 is largely governed by the desired strength of the drum wall which may be weakened when too much structural wall material is removed by cutting away an inordinate large portion of the wall with large apertures. Also, the surface of the drum wall 2 has to be adequate to properly track the endless sieve surface and support it. When oleophilic spheres 31 (or other oleophilic free bodies) are contained in the drum, it is good practice, but not necessary, to keep the drum wall apertures 37 at least smaller than the sphere size such that there is minimal or no deformation of the sieve due to oleophilic spheres or free bodies 31 pushing against the sieve 5 through the drum apertures 37.

Figure 6:
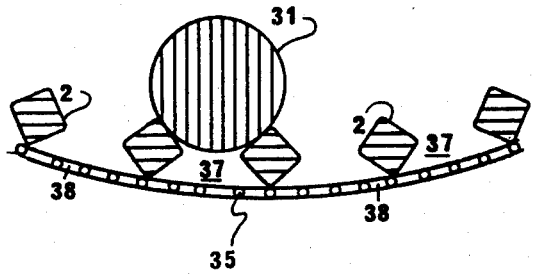
FIG. 6 is a detailed drawing of a grizzly wall, a free body inside the grizzly and with an endless sieve in contact with the outside surface of the grizzly.

FIG. 6 is an enlarged view of a section of an apertured cage wall 2 in the form of a grizzly in contact with the oleophilic sieve 5. The grizzly bars are shown to make up the wall 2 and the spaces 37 between the grizzly bars are apertures. Oleophilic spheres 31 are shown inside the grizzly. A grizzly has the advantage that the total solid wall area in contact with the oleophilic sieve is less, when compared with a drum wall that has round holes as apertures, and, as a result, permits more open area on the sieve for passage of aqeuous phase and attachment of the oil phase adhesive and mineral particles mixture. Other methods of increasing the total area of oleophilic sieve available for sieving and oil phase-mineral mixture capture may be used instead of grizzly bars. Flat bars may be used to form the cage or spacer bars may be mounted on the outside of the apertured drum wall to keep the sieve away from the drum wall and, thereby, increase the proportion of oleophilic sieve area not covered by the solid surfaces of the cylindrical drum wall. Optimum use of the sieve area is obtained when the oleophilic sieve is adequately supported by as little of solid surfaces of the cage as possible.

While the above separation zone embodiments have mostly been described in terms of a method wherein an oil phase adhesive has been added to the slurry inside the rotating drum or grizzly to coat mineral particles with the adhesive, the same or similar results may be obtained using a sticky or viscous oleophilic oil phase adhesive coating on the sieve. Any available viscous oil phase adhesive coating material, as previously mentioned, may be utilized that is recoverable and cost effective. Typical viscous materials include bitumen, grease, kerogen oil, tar, petroleum jelly, pine oil, heavy oil, crude oil, vegetable oil, animal fat and the like. Hence, any of the above described embodiments may be carried out by omitting the oil phase adhesive from the slurry mixture and coating the sieve with the same oil phase adhesive coating material. Or, if desired, both oil phase in the slurry and as a coating on the belt may be used.

Whether placed in the slurry or applied to the sieve, the adhesive serves the same purpose, i.e., as a glue or adhesive to bind the mineral particles to the sieve in the separation zone and allow recovery of the minerals from the sieve in a recovery zone. After the minerals are recovered and separated from this adhesive, the adhesive may be recycled back to the slurry or recoated on the sieve for additional mineral separation.

Thus, in summary and in reference to all figures described in this section, in the separation zone 11, mixture 4 is uniformly distributed by tumbling in a cage such as, for example, a rotating drum or a grizzly 1 that has an apertured cylindrical surface 2 partly covered with an oleophilic conveyor sieve 5, and the mixture 4 is brought up to sieve speed and then flows to the sieve 5 through the openings 37 of the cage. Aqueous phase and gangue of the mixture then passes through the apertures 38 of the oleophilic sieve 5 for removal while mineral particles and oil phase adhesive 20 are captured by the sieve surfaces and is conveyed out of the separation zone 11. Some of the residual aqueous phase carried out of the separation zone by the sieve 5 in association with the mineral and oil phase mixture 20 is removed from the sieve as is convenient (roller 12 of FIG. 2, air knife 42 of FIG. 4), and then the mineral particles and oil phase mixture on the sieve is conveyed into a recovery zone 19 where the mineral particles and oil phase 20 are removed as a mixture from the sieve 5 for further processing to recover the minerals from the oil phase. The process is continuous in that the mixture 4 continuously enters the cage 1 for separation and the conveyor sieve 5 revolves continuously and sequentially through the separation and recovery zones.

Recovery Zone

After the mixture of mineral particles and oil phase adhesive 20 coated on sieve 5 surfaces enters the recovery zone 19, oil phase and mineral particles 20 are removed from the sieve 5 to become the final product of the process of the claimed invention. The subsequent separation of mineral particles from oil phase may be accomplished by various means and do not form an essential part of the present process. Improved methods used for mineral and oil phase adhesive removal are illustrated in FIGS. 1, 2, 3 and 7. These methods are disclosed in the following description, but not necessarily in numerical order.

In FIG. 2, the mineral and oil phase adhesive mixture 20 contained on the apertured oleophilic sieve 5, after removal of residual aqueous phase, by means of deflection roller 12, comes in contact with steam heated conveyor roller 13 in insulated housing 15. Steam enters the roller 13 interior via outlet **14*a* through a rotary seal mounted in the hollow shaft 14 of the roller and condensate leaves the roller through another seal in the hollow roller shaft at the other end of the roller. The roller surface is at a high temperature because of the steam pressure inside the roller and this results in rapid heating of the sieve 5 and its mineral and oil phase adhesive mixture contents 20. Some of the mineral and oil phase mixture 20 remains on the surface, which may or may not be oleophilic, of the heated roller 13 and is scraped off with a doctor blade 29, while the remaining mineral and oil phase adhesive mixture on the sieve 5 is passed between two resilient oleophilic rollers 27 and 27*a* that squeeze the mineral and oil phase mixture 20 from the sieve 5. As the sieve apertures 38 pass beyond the nip 39 of the resilient rollers 27 and 27*a*, mineral and oil phase mixture 20 is pulled out of the apertures and forms mounds 26 on the roller surfaces, and these mounds revolve with the roller surfaces back to the front of the rollers where the mineral and oil phase mixture 20 is squeezed off the sieve 5. These mounds add to the mineral and oil phase mixture 20 squeezed from the sieve. The mineral and oil phase mixture removed from the sieve in this manner falls into a hopper 17 from where it is removed for subsequent mineral separation and oil phase recycle, if desired. The apertures 38 in the sieve surface returning to the recovery zone 11 are open because the mineral and oil phase mixture 20 has been pulled out of them by the oleophilic surfaced rollers 27 and 27*a*, and the separation process continues as the sieve surfaces sequentially and continuously pass through the separation zone 11, the recovery zone 19** and back to the separation zone, etc.

An alternate recovery zone is illustrated in FIG. 3. In this case, the conveyor roller 13 is heated and used directly to squeeze heated mineral and oil phase adhesive mixture 20 from the sieve 5 with the assistance of a second squeeze roller 27 that presses the sieve surfaces tightly against the heated conveyor roller 13 to form a nip 39. Rollers 13 and 27 are contained in insulated housing 15. Recovery efficiency is improved by adding a second heated roller 13*a*, which is placed so as to increase the amount of wrap of sieve surface on the heated roller 13 for more effective heating of the mineral and oil phase mixture on the sieve. A jet of air from air knife 16 may be used if it is necessary for some types of mineral and oil phase mixtures or for some recovery zone temperatures to blow residual mineral and oil phase mixture out of the sieve apertures 38 before these return to the separation zone 11. This blown off mineral and oil phase mixture returns to the sieve or hot rollers for subsequent recovery as it reenters the nip between the rollers 13 and 13*a*. The second roller 27, which forms the nip 39 with the heated roller 13, may have an oleophilic surface, and when it does, it will pull mineral and oil phase mixture out of the sieve apertures after these pass the roller nip 39. This also serves to reopen the sieve apertures 38 for return to the separation zone, and the mineral and oil phase mixture mounds 26 thus pulled out of the apertures 38 returns back to the roller nip 39 for eventual removal as the mineral and oil phase mixture is squeezed off the sieve surfaces and off the roller surfaces. The squeezed off mineral and oil phase mixture 20 falls into a hopper 17 for removal through outlet 34 at the bottom thereof by pump means 17*a* as the desired product of the process.

Figure 7:
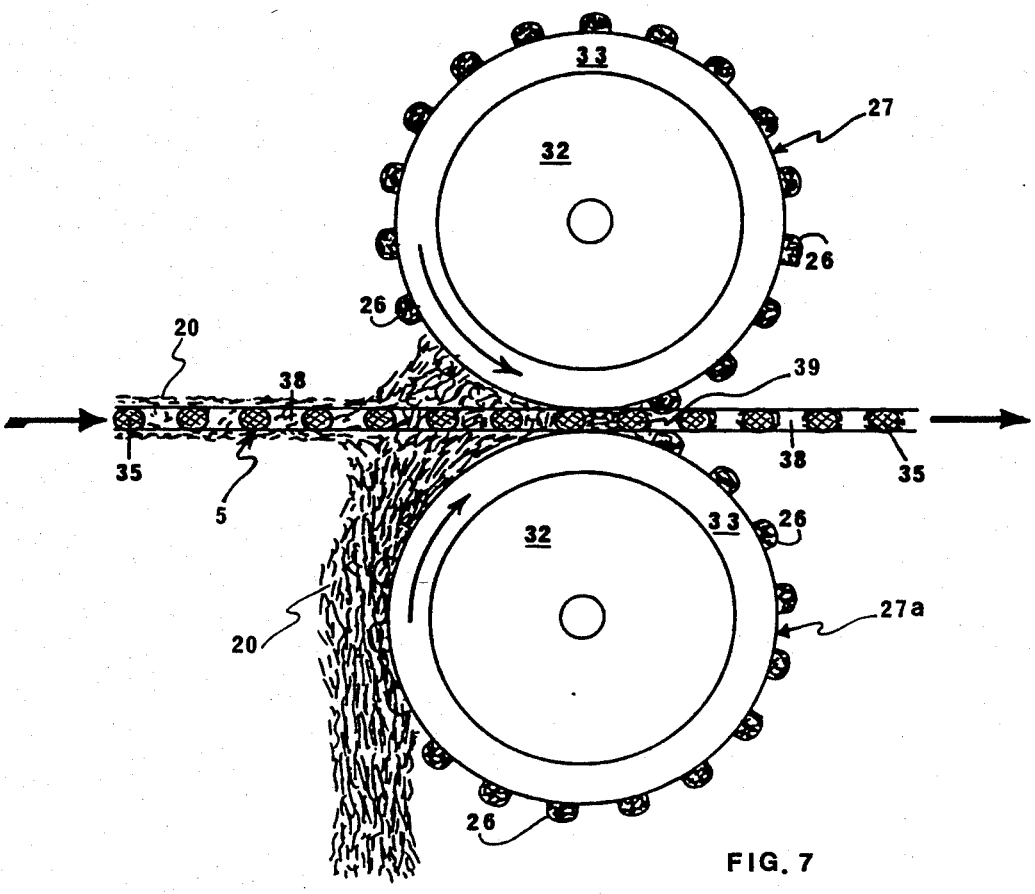
FIG. 7 is a detailed drawing of two squeeze rollers that are used to remove minerals and oil phase from an apertured oleophilic sieve.

The concept of using the nip between two rollers as discussed in the description of the recovery zone of FIGS. 2 and 3 is illustrated in more detail in FIG. 7. The apertured oleophilic sieve 5, consisting of strands 35 with apertures 38 between the strands, moves through the nip 39 between two squeeze rollers 27 and 27*a*. In the drawing, both rollers 27 and 27*a* are oleophilic and are made from a solid core 32 and a resilient oleophilic coating 33. It is preferable, but not necessary, for both rollers to be oleophilic. For example, the hot roller 13 of FIG. 3 need not be oleophilic. The rollers of FIG. 7 are supported by shafts (not shown) that are held in bearings (not shown) that permit rotation, but fix the position of each roller shaft. The shafts may be idler shafts or may be driven to provide movement to the sieve 5. Mineral and oil phase adhesive mixture 20 coated on sieve surfaces enters in moving from left to right, as indicated by the directional arrows and moves through the nip 39 between the roller. The distance between the roller surfaces at the nip 39 is such that sieve strands 35 can pass through the nip. Resiliency of the oleophilic roller coatings 33 permits variations between the thicknesses of the strands passing through the nip. In between the strands 35 the amount of mineral and oil phase mixture 20 that can pass through the nip 39 is a direct function of the distance between the roller surfaces in the nip and the size of the sieve apertures 38. Any excess mineral and oil phase mixture 20 that can not pass through the nip 39 is squeezed off the sieve 5 and accumulates in front of the rollers 27 and 27*a*. Since the sieve 5 is apertured, there is flow of mineral and oil phase mixture possible through the sieve apertures in front of the rollers and, when the mineral and oil phase mixture 20 in front of the rollers has accumulated in amounts that cannot be sustained there, the mixture above the sieve passes through the sieve apertures 38, joins the mixture below the sieve and together fall off the bottom roller 27*a*, as is illustrated in FIG. 7 into collection means (not shown).

After the sieve apertures pass the nip 39 of FIG. 7, the oleophilic surfaces of the rollers, which adhere to the mineral and oil phase mixture in the apertures, pull mineral and oil phase mixture 20 out of these apertures 38. The mineral and oil phase mixture 20 contained in each aperture 38 at this point becomes distributed between the surfaces of the sieve strands 35, the surface of the top roller and the surface of the bottom roller. The amount of mineral and oil phase mixture retained by each is influenced to a degree by the oleophilic attraction of mineral and oil phase mixture 20 for each of these three surfaces. The net effect is that mineral and oil phase mixture is removed out of the apertures 38 to provide open sieve apertures before that sieve portion returns back to the separation zone 11. Open sieve apertures 38 are required to permit aqueous phase to pass through the sieve 5 in the separation zone. Mineral and oil phase mixture pulled out of the apertures 38 by the roller surfaces in this manner remains on the roller surfaces in the form of mounds 26, which revolve with the roller surfaces back to the roller nip 39, and add to the mineral and oil phase mixture accumulating in front of the rollers 27 and 27*a* for removal. The mounds 26 of mineral and oil phase mixture on the roller surfaces pulled out of the sieve apertures are very distinct when the mineral and oil phase adhesive mixture is cold and/or has a high viscosity, but tend to spread out on the roller surfaces and are not as distinctly visible when the mineral and oil phase adhesive mixture is hot and/or has a low viscosity. When one of the rollers is less oleophilic than the other roller, the amount of mineral and oil phase mixture carried back to the nip by that less oleophilic roller will generally be less than the amount of mineral and oil phase mixture carried back by the more oleophilic roller. Similarly, when the roller surfaces are less oleophilic than the sieve strands, the amount of mineral and oil phase mixture removed out of the apertures will be less than when the roller surfaces are more oleophilic.

Mineral and oil phase adhesive mixture of relatively high viscosity may be removed from the apertured oleophilic sieve in the manner just described without heating. Preheating the mineral and oil phase mixture on the sieve, as shown in FIGS. 2 and 3, serves to increase the fluidity of the mineral and oil phase mixture and causes it to fall more readily through the sieve apertures and/or off the rollers in the recovery zone to become the recovered final product. Heating of the mineral and oil phase mixture before it reaches the nip between the rollers also reduces wear on the sieve and roller surface and reduces the mechanical energy required in the recovery zone for squeezing the mineral and oil phase mixture and pulling it out of the apertures. Since the mineral and oil phase mixture in many cases will be further processed by processes which require mineral separation from the oil phase adhesive at an elevated temperature, preheating of the mineral and oil phase mixture on the sieve prior to recovery is a convenient approach to efficiently producing a product for subsequent processing.

Figure 11:
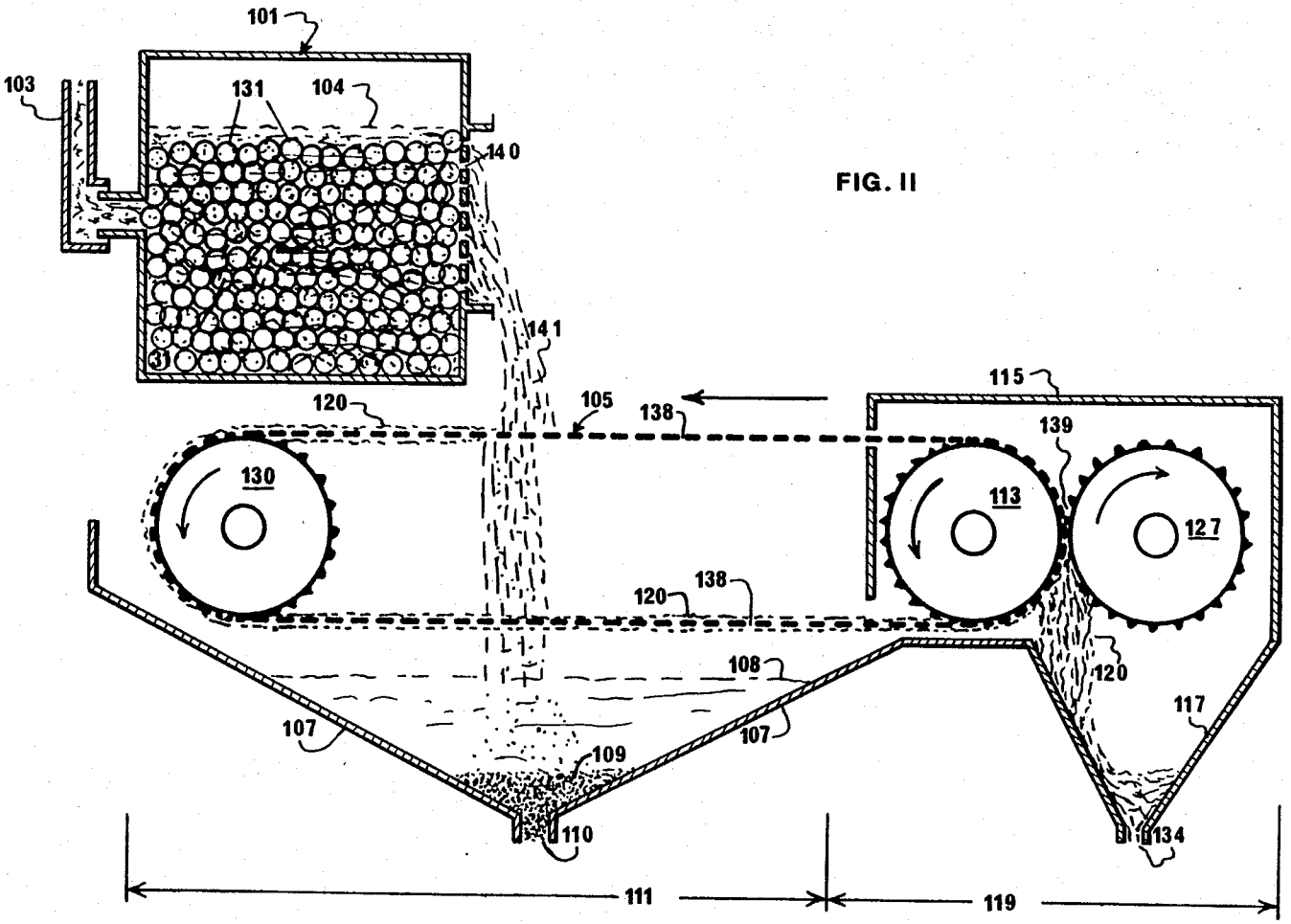
FIG. 11 is a cross sectional view of a separate agglomerator drum and a separate oleophilic sieve conveyor in a separation zone combined with a recovery zone using heated squeeze rollers.

FIG. 11 shows a system and method that is unique insofar as the recovery zone 119 is concerned. However, the separation zone 111 is similar to that disclosed and claimed in U.S. Pat. Nos. 4,224,138 and 4,236,995, and in copending application Ser. No. 283,179 filed July 14, 1981 now abandoned. The separation zone 111 is illustrated to show certain problems encountered in the operation of that system, which have been solved in the present invention. In reference to FIG. 11, a mixture 104 consisting of minerals and gangue slurried in water to which an oil phase adhesive has been added, enters a rotating tumbler 101 via inlet 103 and is prepared for mineral separation by mixing in tumbler 101 in the presence of oleophilic surfaced free bodies 131. The slurry mixture 141 containing oil phase adhesive-coated mineral particles exits tumbler 101 through apertures 140 in an endwall and falls onto the surface of the top flight of an endless oleophilic apertured conveyor belt supported by conveyor endrolls 130 and 113 above a bath 107. The slurry 141 falls onto the top flight of belt 105 rotating as indicated by the directional arrows. A portion of the adhesive-coated mineral particles adhere to the oleophilic surface of the belt as mixture 120. The aqueous phase containing the gangue and some of the adhesive-coated mineral particles fall through the apertures 138 in the belt onto the lower second flight where additional mineral particles 120 adhere to the belt surface, and water and gangue fall into bath 107, having a water level 108. The gangue particles 109 collect in the bottom of bath 107 and are removed via outlet 110. The relative or impact velocity between the falling slurry 141 and rotating belt 105 creates a disturbance preventing some of the adhesive-coated mineral particles from adhering to either the top or bottom flight of the belt. In the present invention, the sieve and tumbling cage operate in tandem at essentially the same surface speed, thereby virtually eliminating any operational problems caused by relative or impact velocity.

The recovery zone shown in FIG. 11 encompassed by insulated cover 115 illustrates the removal of mineral and oil phase adhesive mixture 120 from the sieve 105 with or without the use of heat. Although, as explained above, the separation zone illustrated by FIG. 11 is generally disclosed in U.S. Pat. Nos. 4,224,138 and 4,236,995, and copending application Ser. No. 283,179 now abandoned, the mineral and oil phase mixture recovery technique is new and represents one embodiment that may be utilized in the present invention. In the recovery zone 119, conveyor roller 113 and squeeze roller 127, surrounded by insulated cover 115, are used to squeeze mineral and oil phase mixture 120 from the sieve 105 at the nip 139 of the rollers. Either or both rollers may be heated or they may both be left unheated, and mineral and oil phase mixture 120 is removed from the sieve 105 heated or unheated into hopper 117 for removal through outlet 134, as is suitable for the mineral and oil phase mixture being recovered and as explained above.

In another embodiment, the removal of mineral and oil phase adhesive mixture in the recovery zone 19 by heating this mixture on the sieve and forcing it off the sieve by various other external forces is illustrated, in part, in FIGS. 1 and 4. The mineral and oil phase adhesive mixture 20 on the sieve 5 is heated by a hot conveyor roller 13 and this mixture 20 may be removed from a roller by gravity with the help of a doctor blade 29 on the surface of the heated roller 13 (FIG. 4), removed by shaking the reduced viscosity mixture from the sieve (not shown), removed by centrifugal force around the hot roller throwing reduced viscosity mixture from the sieve (not shown) or removed by centrifugal force around a deflecting roller that deflects the sieve after contacting by the hot roller and throws mixture off the sieve due to the change of direction of movement of the sieve by the deflection roller (FIG. 1), or removed by blowing reduced viscosity mixture from the sieve with a jet of air or steam (FIG. 4). When a jet of steam is used, preheating of the mineral and oil phase mixture may also be done by containing exhaust steam from the steam jet for some distance close to the sieve, upstream (along the sieve) from the stream jet. In this manner, the mineral and oil phase mixture on the sieve passes through a passage that contains the exhaust steam from the steam jet or steam knife before this preheated mineral and oil phase mixture is blown off the sieve by the steam jet.

The recovery zone of FIG. 1 illustrates the use of a heated roller 13 to reduce the viscosity of the oil phase adhesive portion of the mineral and oil phase mixture on the sieve 5 by heating it. An insulated cover (not shown) can be provided around this heated roller 13 to contain the heat. From the heated roller, conveyor sieve 5 is directed to the surface of a deflection roller 18, supported by shafts 36 mounted in bearings **47*b*. Roller 18 is of smaller diameter than the heated roller to impose a sharp deflection on the sieve surface after heating. The centrifugal forces near the deflection point, which can be calculated from the sieve surface speed, the belt thickness and the diameter of the deflection roller, serve to throw reduced viscosity mixture from the sieve surface into a chute or hopper 17 for removal as the recovered product of the process. An additional cover (not shown) can be provided on the back side of the roller opposite the deflection point to catch mineral and oil phase mixture that is pulled out of the apertures of the sieve by the deflection roller surface and sprays off the roller under the influence of centrifugal force around the deflection roller. Steam enters the hot roller 13 through an inlet 14*a* to a hollow shaft 14 through a double rotary seal 43 held by bearings 47*a*. Removal of condensate out of the roller is accomplished through the same hollow shaft 14** through a condensate tube (not shown). The use of double rotary seals in rotating shafts is a common method for transmission of steam into machinery and condensate out of revolving machinery.

The amount of centrifugal force available for forcing heated mineral and oil phase mixture to leave the sieve may be calculated directly from:

$$F=(WV^2)/(gr)$$

where F is the centrifugal force in grams, W is the mass of the mineral and oil phase mixture in grams, V is the oleophilic sieve conveyor speed in centimeters per second, g is the acceleration of gravity, usually taken as 981 centimeters per second per second, and r is the radius of curvature of the sieve at the sieve inflection point in centimeters.

The recovery zone illustrated in FIG. 4 makes use of a relatively large heated roller 13 to heat the mineral and oil phase mixture 20 on the sieve 5. An air knife 16 then blows the heated mixture from the sieve 5 with a jet of air. Residual hot mixture carried along by the surface of the hot roller may fall off the roller or be removed by a doctor blade 29 scraping the roller surface or may be permitted to revolve back to the mixture coated sieve for later removal from the sieve by air jetted from the air knife 16. Mineral and oil phase mixture 20 leaving the sieve 5 is collected in a hopper 17 for removal from the separation zone as the product of the process. An insulated cover 15 encloses the heated roller to reduce heat loss from the process.

FIG. 4 also illustrates a means wherein oil phase adhesive coating on the oleophilic surface of sieve 5 can be applied or restored as necessary. After mineral and oil phase mixture 20 has been removed from the sieve in recovery zone 19 and before the sieve reengages drum sidewall 2 in separation zone 11, a coating of oil phase adhesive 24 may be applied. As shown, the adhesive 24 is applied from a hopper 23 onto the surface of sieve 5 and passed between the nip of two squeeze rollers 25 and 25*a* to ensure a uniform application. Rollers 25 and 25*a* are oleophilic and serve to pull adhesive out of the sieve apertures which form mounds that revolve back to the nip between those rollers and assure that the sieve is recoated with hydrocarbon, but that the sieve apertures are open before the sieve returns to the separation zone. Suitable coating materials have already been mentioned.

One method of recoating the sieve is described in reference to FIG. 4; however, other procedures may also be used which will be obvious to one skilled in the art. It is essential that the sieve, if heated in the recovery zone, be cooled so that the coating material will adhere to the sieve when applied. It is also essential that the coating material be sufficiently fluid that an even coating can be applied to the sieve surface. Finally, it is essential that the coating be removed from the sieve apertures so that the sieve can function as described when it re-enters the separation zone in tandem with the rotating cage.

Thus, in summary, mineral and oil phase adhesive mixture conveyed by the sieve surfaces out of the separation zone 11 is removed from the sieve surfaces in the recovery zone. This may be done by squeezing the mixture of the sieve with at least two rollers that form a nip to put pressure on the mineral and oil phase mixture on the sieve and by pulling this mixture out of the apertures after these have passed the nip between the rollers such that mounds of mixture form on the roller surfaces, which then revolve back to the nip to add to the excess mineral and oil phase mixture squeezed off the sieve. Such removal may be done with mineral and oil phase mixture as it arrives unheated on the sieve from the separation zone, or it may be preheated by one or more heated rollers to decrease the viscosity of the oil phase adhesive and make it flow off the heated sieve more easily when squeezed. The heat flux from the rollers to the sieve and to the oil phase of the mixture may be controlled to make the oil phase adhesive very fluid or just enough to soften the oil phase adhesive so that the mixture will be squeezed off the sieve without difficulty. The preferred oil phase adhesive viscosity for removal of mineral and oil phase mixture from the sieve in the recovery zone is a matter of optimization of the equipment and needs to be established for each mineral and oil phase mixture recovered and each mixture being separated. Alternately, the mineral and oil phase mixture on the sieve may be heated by a roller sufficiently hot to cause the mixture to flow off the sieve under the influence of an applied force. Centrifugal force may be used at the heated roller surface to remove the heated mixture from the sieve by running the sieve conveyor fast enough, by selecting a small enough diameter hot roller and by heating the roller hot enough to give enough centrifugal force and enough fluidity to the oil phase adhesive for the mixture to be thrown clear from the sieve while the sieve is still in contact with the surface of the heated roller, and a doctor blade may be used, if desired, to remove hot mixture from the surface of the hot roller not covered by the sieve. Heated, reduced viscosity, mineral and oil mixture phase may also be removed by shaking the sieve or by training the sieve over a small diameter deflection roller. The smaller the diameter of this deflection roller, the sharper the sieve deflection and, for a given sieve surface speed, the greater the centrifugal force at the deflection point to throw reduced viscosity mixture from the sieve. Finally, a jet of fluid, such as air or steam, may be used to blow mixture from the sieve. Preheating of the mineral and oil phase mixture and the sieve would normally be required when cold air is used to blow mixture off the sieve. Other sources of energy such as infrared rays, microwave rays, inductive energy or hot gasses may be used as well to heat the sieve in the recovery zone for affecting mineral and oil phase mixture removal.

The overall concept of the present invention relates to operating the separation zone at a lower temperature than the recovery zone to make use of the differences in adhesion properties and viscosities of oil phase adhesive at different temperatures in conjunction with an endless oleophilic sieve to achieve most efficient mineral mixture separation at an optimum separation temperature in a separation zone and to achieve most efficient mineral and oil phase adhesive mixture removal from the sieve at an optimum recovery temperature in a recovery zone. In the separation zone, the apparatus configuration is controlled to optimize mixture distribution on the sieve at optimum separation temperature, optimum removal of aqueous phase and optimum transfer of mineral and oil phase mixture to the sieve for capture. The best method for each type of mineral and oil phase mixture can be determined by a few simple performance tests in a prototype apparatus. In some cases, it is not necessary to operate the two zones at different temperatures. However, it is not anticipated that the recovery zone will operate efficiently at a lower temperature than the separation zone.

In general, the separation zone will operate at temperatures between about 1° and 99° C., and preferably between about 15° and 65° C. The recovery zone will operate at temperatures between ambient and 150° C., and preferably between about 25° and 105° C.

Sieve Tension and Tracking Control

Figure 9:
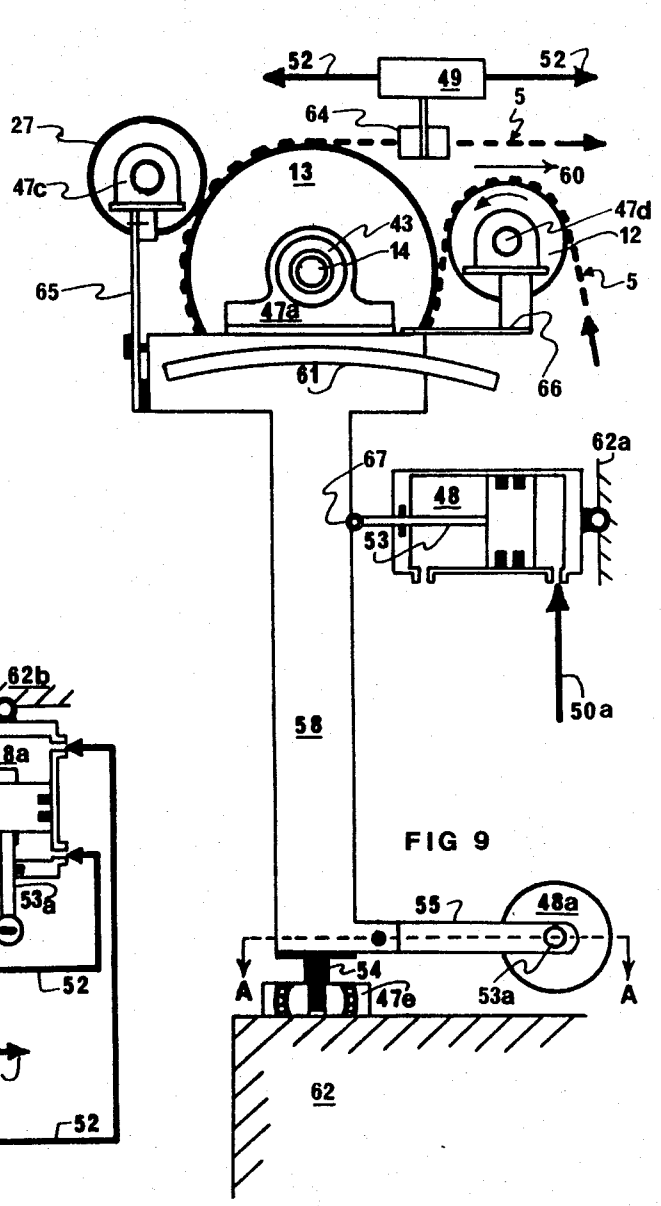
FIG. 9 is a cross sectional view of a sieve tensioning and tracking means that may be used with the systems shown in FIGS. 2 or 3.
Figure 10:
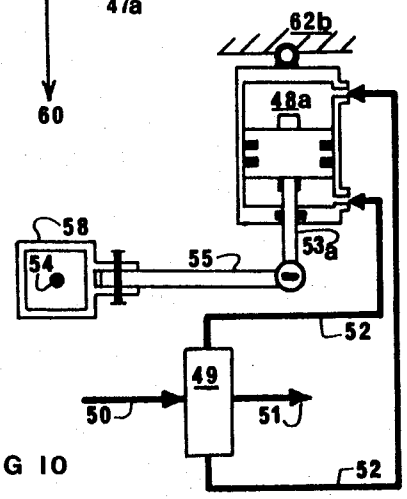
FIG. 10 is a cross sectional view taken through section A—A of FIG. 9 to show vertical frame rotation control means in more detail.
Figure 8:
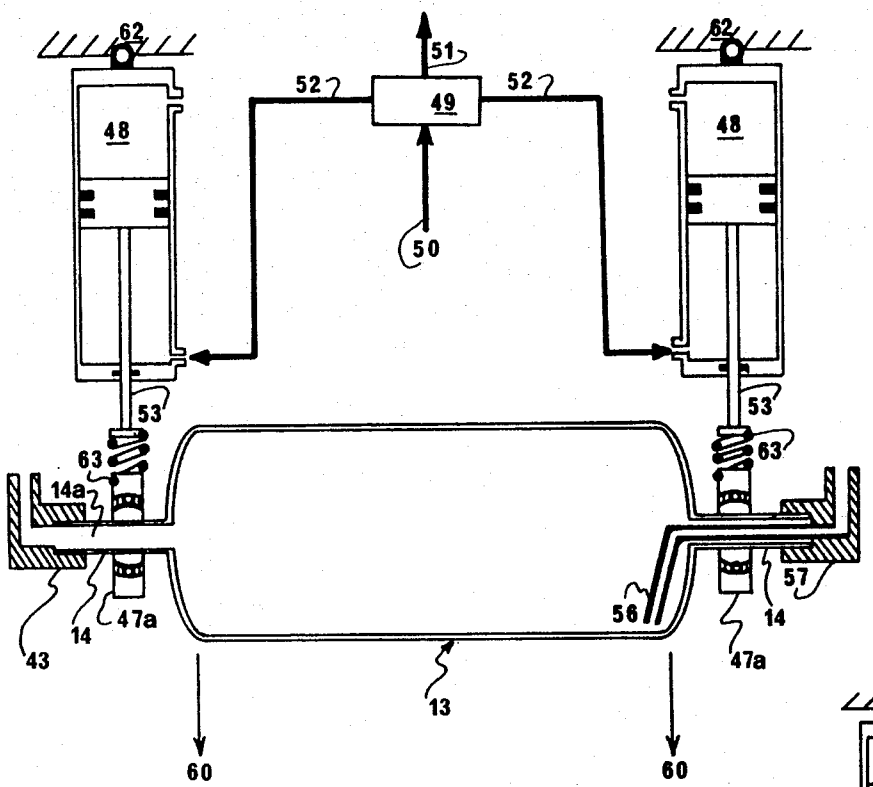
FIG. 8 is a cross sectional view of a sieve tensioning and tracking means that may be used for the systems shown in FIGS. 1 or 4.

The oleophilic endless sieve of the present invention can be the most delicate part of the system utilized to carry out the process and it is normally exposed to a harsh environment that can do severe damage to the sieve if not properly protected. Any refinements that may be provided to minimize wear and tear on this sieve will serve to increase the effective operation period of the equipment before maintenance is required. FIGS. 8, 9 and 10 illustrate convenient methods for mounting rollers or recovery sections to minimize excess tension and stress variations on the sieve.

FIG. 8 illustrates the use of two air cylinders 48 to provide smooth and uniform tension shown by arrow 60 to a heated conveyor roller 13, such as used in FIG. 1 or 4. Each air cylinder 48 attached to a solid base 62 supports one of the roller shafts 14 and bearing blocks 47*a*. An air valve 49 is used to control the relative amount of air and pressure in each cylinder via lines 52. The air valve 49, supplied by instrument air 50 and provided with an air bleed 51, can preferably be controlled by signal means which monitor the position of the endless sieve (not shown) just after it leaves the roller 13 surface in order to provide accurate control of sieve tracking on the cylinder surfaces of the cage and conveyor roller, or, in the alternative, it can be controlled by the position of the sieve anywhere along its length. Any of various devices may be used as the signal means, such as limit switches, photoelectric beams, electrical sensing devices, levers that control air valves, and the like. The pressure of the instrument air in the cylinders controls the tension on the sieve and accommodates a change in the sieve portion due to sieve stretch or shrinkage without adding to the stresses. When the sieve stretches, the cylinders 48 adjust the position of their piston shafts 53 to accommodate the added sieve length and to keep the desired tension 60. When the sieve shrinks, the cylinders adjust the position of their piston shafts 53 to accommodate the reduction in sieve length without adding to the tension. This is of particular advantage when a hot recovery zone and a cold separation zone along the same sieve cause variations in sieve position due to a sieve stretch or shrinkage during operation and during start up. The controlled air valve in conjunction with the support cylinders provide very effective control of sieve tension and tracking, as monitored by the signal means.

FIG. 8 shows springs 63 mounted between piston shafts 53 and the bearings 47*a*. This may be done to smooth out small variations in sieve tension caused by slight eccentricities of the rollers as they roll or by lumps of solids that inadvertently may be carried along the cylindrical revolving surfaces under the sieve.

FIG. 8 also serves to further illustrate use of a rotary joint 43 for supply of steam through the inlet 14*a* of the hollow shaft 14 of a hot conveyor roller 13 in a recovery zone that uses steam condensing on its inside wall to heat the roller. Condensate leaves through the hollow shaft 14 through a rotary seal 57 housing a stationary standpipe as shown, or by a rotating shoe mounted on the inside cylinder wall which scoops up the condensate and permits it to flow through the outlet in rotary seal 57. In FIG. 8, steam enters through a hollow shaft at one end of the roller and condensate leaves through the other end of the roller. Another approach is to introduce steam into the roller at one end and to remove condensate from the same end by the use of a double rotary seal which permits steam to enter through an annulus and condensate to leave through a central tube in this annulus. Rotary seals and their use is well known to those skilled in the art.

A method for providing sieve tension and tracking to a recovery zone, such as the recovery zone of FIG. 2 or 3, is illustrated in FIG. 9. The mineral and oil phase mixture loaded oleophilic sieve 5 is wrapped around the heated conveyor roller 13 with a deflection roller 12. The sieve 5, after mineral and oil phase mixture removal, returns back to a separation zone (not shown). A squeeze roller 27 is mounted in bearings blocks 47*c* to press against the heated roller 13 and to squeeze heated mineral and oil phase mixture off the sieve 5. As illustrated in FIG. 9, leaf springs 65 are used to tighten the squeeze roller 27 against the heated roller 13, and leaf springs 66 may be used also to provide some flexibility to the deflection roller 12, as is illustrated. This flexibility in the position of the deflection roller will smooth out rapid cyclic variations in sieve tension which are caused by roller eccentricities or by irregularities of the cylinder wall of the separation zone drum. The recovery system of FIG. 9 is mounted on a frame or pillar 58 which can swivel slightly relative to the longitudinal axis of the pillar, with respect to a solid base 62*a*, and which can resolve about the base of the pillar to permit lateral movement of the axis of roller 13 to permit the pillar to turn through a small angle of horizontal tilt and a small angle of vertical rotation by means of a pin 54 mounted in a bearing 47*e* that can rotate and swivel and that is mounted to a solid base 62. A piston shaft 53 of an air cylinder 48 is mounted on a swivel pin 67 at the side of the pillar 58 above its mid point, as illustrated, to provide the horizontal tilt. This air cylinder, mounted with a flexible mounting to base 62*a*, is supplied with compressed air 50*a* to provide tension 60 to the sieve 5. Guides 61, in contact with cam followers mounted in a rigid frame supported by a solid base (not shown) prevent sideways movement of the pillar in a direction perpendicular to the axis of roller 13, but permit the air cylinder 48 to tilt the pillar laterally as required, to provide the necessary sieve tension. In addition, a second air cylinder 48*a* as supported by a solid base 62*b* and with its piston shaft 53*a* mounted flexibly with a crank 55, permits vertical rotation of the pillar 58 through a small angle around the pivot pin 54 to rotate the recovery system and make the sieve track on the rollers of the recovery system and on the drum of the separation zone.

Additional details are provided in FIG. 10, which is a cross sectional view of section A—A of FIG. 9. Operation of the air cylinder 48*a* to rotate the pillar 58 (and hence the recovery section rollers) through a small angle around pivot pin 54 is illustrated in FIG. 10. Instrument air 50 supplied to the control valve 49 maintains the desired position of the crank 55 by regulating the amount and pressure of control air 52 going to each side of the cylinder 48*a*. An air bleed 51 assists changes in the cylinder piston shaft 53*a* of the cylinder 48*a*. A flexible cylinder mounting to base 62*b* and non-rigid pin mounting of the crank 55 gives adequate flexing room for positive movement of the cylinder to rotate the pillar through a small angle of rotation required for proper tracking of the conveyor sieve on the rollers. Signal means, such as in the form of a lever arm 64 in contact with the sieve 5 and connected to the air controller 49 is shown in FIG. 9 near the top of the drawing. The lever arm 64 is pushed against the edge of the sieve 5 and any change in the position of this lever arm causes a change in the relative pressure at the two outlets of controlled air 52 from the control valve 49 to the cylinder 48*a* and this, in turn, controls the position of the piston shaft 53*a* which, in turn, transmits to the crank 55 and adjusts the angle of vertical rotation of the pillar 58 to keep the sieve 5 tracking on the rollers. Very precise tracking can be achieved by this method. The cam followers in contact with the guides 61 to prevent sideways movement of the pillar 58 are mounted such as to leave enough room for the required pillar rotation, but prevent excess rotation of the pillar beyond what is required for proper tracking control. Other controlled means for vertically rotating the pillar to cause proper belt tracking may also be used such as a gear driven electric motor. When an electric motor is used for that purpose, electric contact switches are used as signal means to detect the sieve position and to control the electric motor to rotate the pillar to maintained proper tracking of the sieve on the rollers.

While the terms "horizontal" and "vertical" have been used to indicate positioning, these terms are relative. The actual position of the rollers, frames, pillars, and the like, will be dictated by optimal location in an operating plant and, therefore, the terminology is used functionally and not literally.

Air cylinders, therefore, may be used to provide effective tension to the oleophilic conveyor sieve and to accommodate gradual changes in sieve length without putting stress on the sieve. Cyclic variations in tension may be smoothed out and corrected by this method without the use of elaborate air cylinders and without the use of elaborate air control equipment. Springs may be used to smooth out rapid changes in sieve position and tension due to irregularities in the cylindrical surfaces and eccentricity as they rotate. Air cylinders may further be used to control tracking of the sieve on the roller or rollers. Sieve tracking and tension may be provided simultaneously by the use of two cylinders, each supporting one point of the roller mounting or mounting frame and controlling the air pressure in each cylinder with signal means actuated by the position of the sieve. Alternately, one or more air cylinders may be used to only provide sieve tension. In that case, an additional air cylinder may then be used to rotate the roller mounting through a small angle to keep the sieve tracking on the rollers. Alternately, a gear driven electric motor may be used to rotate the roller mounting through this small angle or, alternately, a hydraulic drive motor may be used for that purpose. An air controller following the belt position will be required when the air cylinder is used for rotating the roller mounting, while an electronic or electric control will be required to control the electric motor for the same purpose, or a hydraulic control for controlling the hydraulic motor.

In the drawings, springs are shown to support the conveyor rollers to smooth out fluctuations in the position and tension of the sieve as it moves due to slight eccentricities in the rollers or drum surface or due to solids being caught between the sieve surface and the surface of one or more of the cylindrical surfaces that support the sieve. Alternately, the drum may be mounted in springs for the same purpose or a deflection roller, mounted in springs, may be used instead for the same purpose.

Sieve Operation

Temperature of the sieve in the recovery zone may be as high as is convenient and efficient, provided the sieve is not damaged by this temperature and provided that heat losses do not preclude the use of such temperature or make the process uneconomical.

Sieve apertures are preferably between about 2 and 20 millimeters, but may be larger than 20 millimeters or smaller than 2 millimeters, depending upon the mixture to be separated and the operating conditions chosen. The size of the sieve apertures is influenced to a large degree by the mean and maximum particle size of the solids in the mixture, the concentration of the mixture, the level of liquid in the bath, the viscosity of the aqueous phase and of the oleophilic adhesive phase, the affinity of the oil phase adhesive for the surface of the apertured sieve, the concentration of the minerals and the concentration of the oil phase adhesive, and the rate of mixture flow through the sieve apertures.

The sieve can be a perforated sheet, but preferably is a mesh sieve. Such sieves may be woven from steel wires or from synthetic multistrand or monofilament fibers. Such strands need to be strong enough such that the sieve can be used for extended periods of time in a commercial plant employing this process without fraying or breaking. A coating of vulcanized neoprene or other oil resistant oleophilic abrasion resistant and strong material can be used to provide a bond between the members across the sieve and the members along the endless sieve. Bonding between lateral and cross members can be achieved in multistrand weaves where the strands are twisted or interlocked during the weaving process. It is not intended that this invention be limited to any type of sieve. Other kinds of mesh or perforated endless sieves that can be used for the process will be apparent to those skilled in the art. Nylon mesh sieves as is, or covered with an oleophilic coating, or monofilament polyesther strand mesh sieves have been used successfully in test programs. Steel cable sieves, wherein the individual strands of steel making up the cable have been coated with cadmium or tin to provide an initial oleophilic surface, are suitable as well. Once an oleophilic coating has been established on the steel of the cable, often the cable will remain oleophilic, even if abrasion from gangue strips off part of the initial oleophilic coating, especially at a pH below 8.0.

The sieve surface speed preferably is between 0.04 and 4 meters per second. The optimum sieve speed is to be determined for each type of mixture separated and is influenced to a large degree by the concentration of minerals and oil phase relative to the concentration of the gangue and water in the mixture. When the minerals concentration is very low, the rate of minerals attachment to the surface of the sieve is very slow with respect to the rate of gangue passing through the apertures of the sieve and even at low sieve conveyor speeds there is little danger of blinding of the sieve apertures with liquid hydrocarbon and mineral particles and oil phase adhesive that would prevent the flow of gangue and water through the sieve. Conversely, when the minerals concentration in the mixture is high relative to the gangue, the mineral particles and oil phase adhesive mixture adhering to the sieve surfaces in high concentration will cause blinding of the sieve apertures and will interfere with flow of water and gangue through the sieve unless the sieve velocity is adequate to always present open apertures to the gangue in the separation zone. The sieve speed is normally controlled to provide adequate mixture tumbling and to optimize minerals recovery per sieve area while still keeping enough open apertures to permit effective removal of gangue. The actual desired mineral content of the sieve surface is different for each mixture to be separated and varies with particle size, mineral properties, oil phase adhesive properties and apparatus behavior with the mixture under separation.

Mineral Recovery

After the minerals and oil phase adhesive are recovered as a mixture from the sieve, the mineral product may be cleaned and separated from the oil phase adhesive by solvent extraction, by washing with hot water, by heating, by roasting or burning the recovered mixture to remove the oil phase adhesive and leave the solid mineral particles behind for processing. Chemical or solvent treatment to break the association of the oil phase adhesive with the mineral particles followed by centrifuging or other separation techniques may also be utilized. Solvents which may be used for the oil phase adhesive removal from mineral particles include, for example, hot water with or without detergents, benzene, naphtha, gasoline, diesel fuel, toluene, acetone, alcohols and the like, and mixtures thereof.

The desired minerals can, thus, be recovered substantially free of the gangue and can be used subsequently in their intended applications. Any oil phase adhesive recovered from the minerals clean up step may potentionally be recycled and used again in the initial slurry mixing step of the process or to recoat the oleophilic sieve.

To illustrate the process of the invention, the following examples are given. It should be understood, however, that they are given only in the way of illustration and in no way limit the scope of the invention.

EXAMPLE 1

Diamonds are found in South Africa, the Congo, Tanganyika, Sierra Leone, Brazil, India, Siberia and Arkansas in soil and rock called kimberlite in large vertical lava channels called diamond pipes. The kimberlite is crushed to approximately 5 mesh (2500 micron) and then sieved on a 10 mesh sieve. Since diamonds are very hard, they are not easily damaged by crushing. The oversize material is examined manually for diamonds, which are removed, and then the oversize kimberlite is returned for further crushing. The undersize kimberlite is mixed with water to produce a mixture containing by weight between 10 and 80% kimberlite and between 20 and 90% water and then is introduced into an apparatus similar to FIG. 4 and which is outfitted with oil phase adhesive distribution rollers 25 mounted between the hot roller 13 and the drum 1 surface as illustrated. Refined petroleum jelly 24 is added to the distribution rollers, which coat the apertured oleophilic sieve 23 with a layer of this oil phase adhesive. Refined petroleum jelly is also added continuously to the mixture of the tumbler in proportion of 0.03% by weight of the kimberlite in the drum. The drum or cage tumbler, being 100 centimeters in diameter and 120 centimeters long, is mounted on an 8 centimeter O.D., 6 centimeter I.D. hollow shaft in bearings and a sprocket and chain drive coupled to a hydraulic motor and chain drive are used to cause the drum to turn or tumble at 5 revolutions per minute. Apertures in the cylindrical drum wall are circular holes 10 millimeters in diameter on 15 millimeter staggered centers. In addition, 6 millimeter square cross-section spacer bars are welded longitudinally on the outside of the cylindrical drum wall to keep the oleophilic sieve from contacting the solid surfaces of the cylindrical drum wall and to increase the effective useful area of the oleophilic sieve for the separation. This drum wall is 6 millimeters thick. A bath tank containing water is mounted around and under the drum and the bath is filled with water to immerse the drum to within 10 centimeters below the hollow shaft of the drum. A Moyno pump, mounted vertically at the bottom tank outlet controls the level of the liquid and of the kimberlite gangue after separation in the bath. A steam heated 50 centimeter O.D., 130 centimeter long roller 13 is mounted above the drum using a 50 millimeter O.D., 40 millimeter I.D. hollow shaft mounted in bearings. These bearings are mounted on a frame which permits a slight tilting adjustment of the roller for the purpose of providing proper sieve conveyor tracking on the roller and drum cylindrical surfaces and to provide smooth controlled sieve tension. A 120 centimeter wide oleophilic endless sieve is mounted such that it forms a conveyor supported vertically by the drum wall 2 as one conveyor end roller and by the heated roller 13 as the other conveyor roller. A conveyor tracking device (air control valve) controls the tilting of the heated roller to keep the sieve central upon the drum and the roller surfaces at all times during operation. Steam is introduced into the 50 centimeter roller 13 through a rotary seal at one end through its hollow shaft where it condenses inside the roller to heat the roller surface. Condensate is removed through a stationary standpipe mounted inside the rotating roller, but supported from a rotary seal at the other end of the roller where it leaves through the hollow shaft. The heated roller is enclosed in an insulated cover 15 to contain the heat. A high velocity cold air jet 16 blasts air against the sieve surface to remove hot petroleum jelly and diamonds from off the surface and out of the apertures of the sieve and into the minerals hopper 17. A scraper removes minerals from the heated roller surface. Past the air blast, two 10 centimeters O.D. soft urethane covered rollers, mounted with their surfaces in contact with the sieve, as illustrated in FIG. 4, recoat the sieve surface with cold petroleum jelly, but leave the apertures open. A mechanical frame supports the drum shaft bearings, the tilting frame of the hot roller, the insulated cover, the air jet, the minerals hopper and the tailings tank and Moyno pump.

The apertured oleophilic sieve is a mesh, 2 strands per centimeter, woven from monofilament polyester 1.3 millimeter diameter strands and spliced to form an endless conveyor with smooth edges.

During operation, crushed kimberlite is continuously blended with water and pumped into the rotating drum at a rate of 50 tons of kimberlite per hour. This mixture passes through the drum wall and contacts the apertured oleophilic endless sieve. Kimberlite gangue and water pass through the sieve apertures, but any diamonds present in the mixture are coated with petroleum jelly and captured by the petroleum jelly coated sieve and carried to the heated roller where heat from the roller surface softens the petroleum jelly sufficient that a subsequent blast of cold air will blow the diamonds in the minerals hopper.

In most cases, the roller does not have to exceed 65° C. to achieve the desired softening of the petroleum jelly and in some cases heating of the sieve is not required at all when the air of the blast itself is heated to soften the petroleum jelly enough to permit blowing of the diamonds and petroleum jelly off the sieve surfaces and out of the apertures. It is advantageous to place the minerals hopper 17 in between the conveyor flights and direct the air blast inward in order to remove diamonds from the sieve that are larger than the sieve apertures. Such larger diamonds would remain in between the conveyor flights and return back to the drum wall if these were not blown from the sieve surface into the minerals hopper.

Diamonds and other minerals blown off the sieve, along with the petroleum jelly adhesive, are then removed from the minerals hopper and thrown into hot water where the diamonds sink to the bottom and the petroleum jelly floats. The diamonds are then recovered, dried and packaged while the petroleum jelly adhesive is floated off the water, cleaned, cooled and reused in the process. Cold petroleum jelly is fed to the distribution rollers 25 to recoat the belt.

Cold air is used in this example for removal of the diamonds off the sieve and to cool down the sieve before the petroleum jelly is reapplied. If a hot air blast is used to remove the diamonds instead of a hot roller and a cold blast, then the hot air blast would normally be followed with a cold air blast to maintain a controlled temperature for reapplying the petroleum jelly.

EXAMPLE 2

Diamonds are found all over the world in river bed deposits and on the sea floor. Particularly in India, in Brazil, and off the coast of South Africa diamonds are recovered from the sand and gravel of alluvial deposits on land or on the ocean floor. Diamonds that have been under water for a period of time collect a thin layer of salt which makes them oleophobic and an activator needs to be added to permit recovery of these as in Example 1. The activator used in the instant invention to make such diamonds oleophilic is a mixture of caustic soda and fish oil (whale acid oil).

Sand and gravel containing diamonds are sieved on a 5 mesh per inch sieve (2500 micron) and the oversize is examined manually for diamonds. The undersize mixed with water, as in Example 1, and at the same rate is fed into the drum and is separated as described there by the oleophilic sieve, but with the exception that instead of adding petroleum jelly to the mixture, caustic soda and fish oil are added in an amount equal to 0.1% fish oil based upon the weight of the sand and fine gravel passing through the drum wall. Petroleum jelly is applied to the oleophilic sieve with the distribution rollers, as in Example 1, but the aperture size of the sieve (which is based upon the actual aperture size before coating with petroleum jelly is increased to 6 millimeters to permit convenient passage of the 2500 micron material out of the drum interior into the bath. The amount of caustic soda added to the mixture is equivalent to an amount needed to obtain a mixture pH of 8.5. Removal of gangue from the bath tank and diamonds from the minerals hopper is similar to that described in Example 1.

EXAMPLE 3

Australian beach sand, containing by weight 2% ilmenite, 1% rutile and 0.5% zircon (approximately) are separated by the process of the invention. Ilmenite is an ore containing iron and titanium, rutile is a natural titanium oxide and zircon is a natural ore of zirconium.

One hundred tons per hour of beach sand are sieved on a 1500 micron sieve and the oversize is discarded. Undersize is mixed with 50% water and 5% heavy oil (10° API) by weight and is introduced into the tumbler of FIG. 3 where the ilemite, rutile and zircon becomes coated by the heavy oil. This tumbler is 120 centimeters in diameter and 240 centimeters long and is driven by a sprocket and chain drive at 20 revolutions per minute. Apertures in the cylindrical cage wall are 13 millimeter slits between 25 millimeter thick and wide grizzly bars. Two steam heated rollers, and a squeeze roller, all 30 centimeters in diameter and 250 centimeters long are mounted above the tumbler and supported in bearings in a frame which is supported by air cylinders. A bath tank is mounted around the bottom part of the tumbler. An endless nylon 2500 micron sieve, 245 centimeters wide, made from 1.3 millimeter diameter nylon strands and coated with vulcanized neoprene, is supported by the cylindrical walls of the tumbler and by the heated rollers. The slurry formed in the tumbler is evenly deposited on the endless sieve where the heavy oil and coated ilemite, rutile and zircon, and any additional heavy oil phase adhere to the sieve surface while the remaining beach sand gangue and water phase pass through the sieve apertures. Minerals and heavy oil are continuously heated and squeezed off the sieve into a collection trough and are then scraped out of the collection trough, mixed with gasoline and are then centrifuged to separate the minerals from the heavy oil. The heavy oil is reused in the process as an adhesive after distilling off the gasoline. The minerals, after centrifuging, are processed further to separate these into zircon, ilmenite and rutile enriched fractions and thereafter each fraction is processed as required.

Gangue is removed from the bottom of the water bath with a diaphragm pump and discarded. Water run-off from the discarded gangue is returned for reuse in the process. Liquid level in the bath is maintained with the diaphram pump at approximately 20 centimeters below the center of the drum. The air cylinders used to support the bearings of the roller of the recovery zone in the apparatus frame are controlled with air pressure from a conveyor tracking device to keep the sieve tracking centrally on the rollers and drum surface.

EXAMPLE 4

Molybdite, an ore of molybdenum, is mined in British Columbia, Canada along with gangue and is crushed to minus 10 mesh per inch for separation into a gangue fraction and a molybdite fraction by the process of the invention. Thirty tons per hour of this mined material is mixed with 30 tons of water and 3 tons of Athabasca oil sand bitumen as an adhesive. The apparatus used is illustrated in FIG. 3 and the procedure is described in Example 3. Hot water and a continuous centrifuge are used to remove most of the bitumen from the molybdite fraction and the bitumen-hot water mixture from the centrifuge is returned to the process for mixing with the feed to the drum. The centrifugal solids are processed further to produce the desired molybdenum concentrate. Water run-off from the gangue is cleaned and reused in the process of the invention, as desired.

EXAMPLE 5

River mud, known to contain gold of very fine particle size, so fine that conventional gravity separation methods are not very effective to win this gold, is separated by the process of the invention. The apparatus of FIG. 1, mounted on a dredge barge is used. It has a 200 centimeter diameter, 250 centimeter face length drum, and a 50 centimeter diameter, 260 centimeter face length steam heated roller. An air jet 42 is used to remove water out of the apertures of the sieve after it leaves the separation zone and an air jet is also used to blow minerals and petroleum jelly off the sieve after it has passed by the hot roller. A doctor blade on the heated roller also removes minerals and petroleum jelly. These two streams combine in the mineral hopper. The drum rotates at 10 revolutions per minute to separate 200 tons of mud per hour. An oil phase adhesive is not mixed with the drum contents, but petroleum jelly distribution rollers, as illustrated in FIG. 4, are used to coat the endless sieve surfaces with petroleum jelly after these have passed the air jet 16. Prior to introducing the river mud into the separator, it is sieved through a 35 mesh per inch trommel and the oversize is discarded back into the river. The oleophilic sieve used is woven from polyesther 0.5 millimeter strands with an aperture size of 2 millimeters by 4 millimeters with the long aperture dimension in the direction of sieve movement. Separation is carried out at the temperature of the river water and the petroleum jelly used is especially formulated to have good adhesion properties for gold particles at this temperature. The undersize from the trommel enters the drum of the process and mixes in the drum until it passes through the drum apertures to the sieve where the mud and water pass through the sieve apertures, but where gold particles and other minerals adhere to the petroleum jelly of the oleophilic sieve and are carried out of the separation zone. The mud and water emerging out of the sieve apertures enter the bath which is mounted around the bottom half of the drum and then are pumped back into the river. Minerals and petroleum jelly are pumped with a diaphragm pump out of the minerals hopper into a swirling hot water bath where the mineral particles disperse in the water and the petroleum jelly floats to the top. Petroleum jelly is skimmed off the top of the water bath, is cleaned and cooled and then is reused in the process. Small amounts of mineral that remain in this petroleum jelly return to the process and are recovered eventually as minerals during the course of the separation. Minerals and water from the hot water bath are pumped as a slurry to a centrifuge where most of the water is removed and the minerals are produced as a centrifuge cake. This cake is found to contain gold, iron and other metal oxides, mineral stones, such as garnet and other materials, such as pyrites. The cake is dried and pulverized and then the gold is removed by amalgamation, the now concentrated iron oxide is recovered by magnetic separation. The remaining minerals may be separated from each other by conventional means.

EXAMPLE 6

The material separated and the method used in this example is the same as Example 5 except that very moderate amounts of heat are used in the recovery zone and the heated roller is not supplied with steam, but only with warm water for the purpose of softening the petroleum jelly on the oleophilic sieve. Only a scraper is used on the surface of this warm roller between the conveyor flights to remove petroleum jelly and minerals which have been transferred by contact from the sieve surface to the surface of the heated roller. An air jet is used to remove water out of the sieve apertures before these reach the heated roller, but no air jet is used to blow heated petroleum jelly from the sieve surfaces. Oxygen under pressure in bottles is available on the barge and is permitted to be bubbled into the mixture in the drum while it rotates to improve the oleophilic attraction for gold particles for the petroleum jelly on the sieve surfaces.

While the above specification describes the invention in terms of its best known embodiments, other undisclosed embodiments and applications will become obvious to one skilled in the art from this disclosure. Therefore, the invention is not to be limited solely to the disclosed embodiments, but is to be accorded the full scope of the appended claims.

What is claimed is:

1. A method for the continuous separation and removal of oleophilic surfaced mineral particles from a particulate mixture of oleophilic minerals and oleophobic gangue which comprises:

(a) providing a continuous separation and recovery system consisting of a rotating conveyor in the form of an apertured oleophilic endless sieve of uniform width supported in a separation zone by a cylindrical generally horizontal rotating cage having an apertured cylindrical sidewall, said cylindrical sidewall being partially enwrapped about the circumference thereof by said sieve, said sieve being supported in a recovery zone by a rotating conveyor roller, and said cage, conveyor roller and sieve being rotated in tandem at substantially the same surface speed such that the sieve rotates sequentially and continuously from separation zone to recovery zone;

(b) applying to the surface of said rotating sieve a coating of a viscous oleophilic oil phase adhesive as said sieve surface rotates from said recovery zone to said separation zone;

(c) continuously introducing an aqueous slurry of said particulate mixture into said rotating cage and tumbling said mixture to enhance the oleophilic nature of the surface of said mineral particles and maintain the oleophobic surface of said oleophobic gangue in contact with water to prepare said mixture for distribution on said sieve;

(d) continuously transferring said aqueous slurry mixture through the apertures of said cylindrical sidewall of said cage onto the surface of said oleophilic oil phase adhesive coated oleophilic sieve across the width thereof causing the mineral particles to contact and adhere to the oil phase adhesive coating on the surfaces of said sieve and the oleophobic gangue particles and aqueous phase to pass through said sieve apertures; and (e) continuously rotating said sieve containing said adhered mineral particles and oil phase adhesive away from contact with said rotating cage and out of said separation zone into said recovery zone wherein heat is transferred to the sieve and where the adhered mineral particles and oil phase adhesive are recovered from said oleophilic sieve; and (f) continuously rotating said sieve away from said recovery zone for recoating with the viscous oleophilic oil phase coating.

2. A method according to claim 1 wherein the oleophobic nature of the surface of said mineral particles in said cage is enhanced by the addition to the slurry of a member selected from the group consisting of activator agents and collection agents and mixtures thereof.

3. A method according to claim 1 wherein the viscous oleophilic oil phase adhesive is a member selected from the group consisting of bitumen, heavy oil, pin oil, crude oil, coal tar, petroleum jelly, grease, kerogen oil, animal fat, vegetable oil and mixtures thereof.

4. A method according to claim 1 wherein said mineral is selected from the group consisting of precious metals, semi-precious metals, precious gemstones and semi-precious gemstones.

5. A method according to claim 1 wherein said mineral is a radioactive mineral or radioactive waste material.

6. A method according to claim 1 wherein said mineral is a naturally occurring sulfide or oxide of a metallic mineral.

7. A method according to claim 1 wherein said rotating cage, in the area enwrapped by said sieve, is partly immersed in a water bath and wherein said oleophobic gangue particles and aqueous phase, after passing through said sieve apertures, collects in said bath for removal.

8. A method according to claim 1 wherein said rotating cage contains oleophilic surfaced free bodies having a diameter larger than the diameter of the apertures in said cylindrical wall, which free bodies come in contact with said oleophilic mineral particles as said mixture and free bodies tumble in said cage causing said activation or collection agents to contact and adhere to the surface of said oleophilic mineral particles and enhance the oleophilic nature of the surface thereof, which oleophilic enhanced mineral particles, along with said oleophobic gangue particles and aqueous phase pass through said apertures in said cylindrical wall onto said oleophilic oil phase adhesive coated oleophilic sieve where said oleophilic enhanced mineral phase particles adhere to said oil phase adhesive coated sieve surfaces.

9. A method according to claim 1 wherein the apertures in said oleophilic sieve are between about 2 and 20 millimeters.

10. A method according to claim 1 wherein said rotating cage is a rotating drum or a rotating grizzly.

11. A method according to claim 1 wherein the mineral particles and oil phase adhesive coating on the oleophilic sieve is partially dewatered as the oleophilic sieve rotates from said separation zone to said recovery zone.

12. A method according to claim 1 wherein the mineral particles and oil phase adhesive coating on said oleophilic sieve is continuously removed from said sieve into collection means by heat applied in the recovery zone to said sieve by means of infra heat, microwaves, induction heating or a stream of hot gas.

13. A method according to claim 1 wherein the mineral particles and oil phase adhesive on said oleophilic sieve is continuously removed from said sieve in said recovery zone by passing said sieve between aligned rollers such that the sieve is squeezed between the nip of said rollers causing mineral particles and oil phase adhesive, which cannot pass the nip to flow off the sieve and rollers and be collected in collection means as a mineral particle and oil phase mixture, and wherein at least one of said rollers has an oleophilic surface which pulls mineral particles and oil phase adhesive out of the apertures of said sieve onto the oleophilic surface of said roller as said sieve passes out of said nip and returns the mineral particles and oil phase adhesive thus removed back to the nip as said oleophilic surfaced roller revolves.

14. A method according to claim 13 wherein at least one of said rollers is a heated roller causing the oil phase adhesive on said sleeve to be reduced in viscosity and thereby flow, along with said mineral particles, more readily as a mixture from the sieve at the nip between said rollers into said collection means.

15. A method according to claim 1 wherein mineral particles and oil phase adhesive coating on said oleophilic sieve is continuously removed from said sieve in said recovery zone by passing said sieve over one or more heated rollers to reduce the viscosity of said oil phase adhesive on said sieve as it passes over said rollers followed by removal of said mineral particles and reduced viscosity oil phase adhesive from said sieve as a mixture into collection means by means of an applied force.

16. A method according to claim 15 wherein the applied force consists of passing said sieve between aligned rollers such that the sieve is squeezed between the nip of said rollers causing mineral particles and reduced viscosity oil phase adhesive which cannot pass the nip to flow off the sieve and rollers into collection means as a mixture.

17. A method according to claim 15 wherein the applied force is a centrifugal force applied against the sieve surface causing mineral particles and reduced viscosity oil phase adhesive to be thrown as a mixture from the sieve into said collection means.

18. A method according to claim 15 wherein mineral particles and reduced viscosity oil phase adhesive adhering to the surface of at least one of said heated rollers is scraped therefrom as a mixture by a doctor blade mounted against the surface of said heated roller and into said collection means.

19. A method according to claim 15 wherein the applied force is a jet of gas which impacts upon the surface of said sieve and blows mineral particles and reduced viscosity oil phase adhesive from said sieve surface as a mixture into collection means.

20. A method according to claim 15 wherein said one or more rollers are heated by steam condensing inside each roller, said steam entering through a rotary seal mounted in the axis of each roller while condensate leaves each roller through another rotary seal mounted at the axis of each roller.

21. A method for the continuous separation and removal of oleophilic surfaced mineral particles from a particulate mixture of oleophilic minerals and oleophobic gangue which comprises:

(a) providing a continuous separation and recovery system consisting of a rotating conveyor in the form of an apertured oleophilic endless sieve of uniform width supported in a separation zone by a cylindrical generally horizontal rotating cage having an apertured cylindrical sidewall, said cylindrical sidewall being partially enwrapped about the circumference thereof by said sieve, said sieve being supported in a recovery zone by a rotating conveyor roller, said cage, conveyor roller and sieve being rotated in tandem at substantially the same surface speed such that the sieve rotates sequentially and continuously from separation zone to recovery zone;

(b) continuously introducing an aqueous slurry of said particulate mixture and an oleophilic oil phase adhesive into said rotating cage and tumbling said slurry and oil phase adhesive within said cage causing said oil phase adhesive to adhere to and coat the oleophilic surfaced mineral particles, thereby forming an oil phase-aqueous phae mixture wherein said oil phase is a mixture of mineral particle and oil phase adhesive, and wherein said aqueous phase contains said oleophobic gangue particles;

(c) continuously transferring said oil phase-aqueous phase mixture through the apertures of said cylindrical sidewall of said cage onto the surface of said oleophilic sieve across the width thereof causing the mixture of mineral particles and oil phase adhesive to contact and adhere to the surfaces of said sieve and the oleophobic gangue and aqueous phase to pass through said sieve apertures; and (d) continuously rotating said sieve containing said adhered mineral particles and oil phase adhesive mixture away from contact with said rotating cage and out of said separation zone into said recovery zone wherein heat is transferred to the sieve and where the adhered mineral particles and oil phase adhesive mixture is recovered from said oleophilic sieve which is then rotated back to said separation zone and into contact with said rotating cage for further transfer onto said sieve of the oil phase-aqueous phase mixture from said cage.

22. A method according to claim 21 wherein the oleophilic nature of the surface of said mineral particles in said cage is enhanced by the addition to the slurry of a member selected from the group consisting of activator agents and collection agents and mixtures thereof.

23. A method according to claim 21 wherein the oleophilic oil phase adhesive is a member selected from the group consisting of bitumen, heavy oil, pine oil, crude oil, coal tar, petroleum jelly, grease, kerogen oil, animal fat, vegetable oil and mixtures thereof.

24. A method according to claim 21 wherein said mineral is selected from the group consisting of precious metals, semi-precious metals, precious gemstones and semi-precious gemstones.

25. A method according to claim 21 wherein said mineral is a naturally occurring sulfide or oxide of a metallic mineral.

26. A method according to claim 21 wherein said rotating cage, in the area enwrapped by said sieve, is partly immersed in a water bath and wherein said oleophobic gangue particles and aqueous phase, after passing through said sieve apertures, collects in said bath for removal.

27. A method according to claim 21 wherein said rotating cage contains oleophilic free bodies having a diameter larger than the diameter of the apertures in said cylindrical wall, which free bodies come in contact with said oil phase adhesive and said oleophilic surfaced mineral particles as said aqueous slurry and oil phase adhesive tumble in said cage causing said mineral particles to become coated with said oil phase adhesive to form the oil phase portion of said oil phase-aqueous phase mixture, which mixture passes through said apertures in said cylindrical sidewall onto said oleophilic sieve where said oil phase adheres to said sieve surfaces as a mineral particle oil phase adhesive mixture.

28. A method according to claim 21 wherein the apertures in said oleophilic sieve are between about 2 and 20 millimeters.

29. A method according to claim 21 wherein said rotating cage is a rotating drum or grizzly.

30. A method according to claim 21 wherein the mineral particles and oil phase adhesive on the oleophilic sieve is partially dewatered as the oleophilic sieve rotates from said separation zone to said recovery zone.

31. A method according to claim 1 wherein the mineral particles and oil phase adhesive adhering to said oleophilic sieve is continuously removed from said sieve in said recovery zone by passing said sieve between aligned rollers such that the sieve is squeezed between the nip of said rollers causing mineral particles and oil phase adhesive, which cannot pass the nip to flow off the sieve and rollers and be collected in collection means as a mineral, particle and oil phase mixture and wherein at least one of said rollers has an oleophilic surface which pulls mineral particles and oil phase adhesive out of the apertures of said sieve onto the oleophilic surface of said roller as said sieve passes out of said nip and returns the mineral particles and oil phase adhesive thus removed back to the nip as said oleophilic surfaced roller revolves.

32. A method according to claim 31 wherein at least one of said rollers is a heated roller causing the oil phase adhesive on said sieve to be reduced in viscosity and thereby flow, along with said mineral particles, more readily as a mixture from the sieve at the nip between said rollers into said collection means.

33. A method according to claim 21 wherein the mineral particles and oil phase adhesive adhering to said oleophilic sieve is continuously removed from said sieve in said recovery zone by passing said sieve over one or more heated rollers to reduce the viscosity of said oil phase adhesive on said sieve as it passes over said rollers followed by removal of said mineral particles and reduced viscosity oil phase adhesive from said sieve as a mixture into collection means by means of an applied force.

34. A method according to claim 33 wherein the applied force consists of passing said sieve between aligned rollers such that the sieve is squeezed between the nip of said rollers causing mineral particles and reduced viscosity oil phase adhesive which cannot pass the nip to flow off the sieve and rollers into collection means as a mixture.

35. A method according to claim 33 wherein the applied force is a centrifugal force applied against the sieve surface causing mineral particles and reduced viscosity oil phase adhesive to be thrown as a mixture from the sieve into said collection means.

36. A method according to claim 33 wherein mineral particles and reduced viscosity oil phase adhesive adhering to the surface of at least one of said heated rollers is scraped therefrom as a mixture by a doctor blade mounted against the surface of said heated roller and into said collection means.

37. A method according to claim 33 wherein the applied force is a jet of gas which impacts upon the surface of said sieve and blows mineral particles and reduced viscosity oil phase adhesive from said sieve surface as a mixture into collection means.

38. A method according to claim 33 wherein said one or more rollers are heated by steam condensing inside each roller, said steam entering through a rotary seal mounted in the axis of each roller while condensate leaves each roller through another rotary seal mounted at the axis of each roller.

39. A method according to claim 33 wherein the mineral particles and oil phase adhesive coating on said oleophilic sieve is continuously removed from said sieve into collection means by heat applied in the recovery zone to said sieve by means of infra red heat, microwaves, induction heating or a stream of hot gas.

* * * * *